US010801746B2

(12) United States Patent
Hanks et al.

(10) Patent No.: US 10,801,746 B2
(45) Date of Patent: Oct. 13, 2020

(54) PROTECTIVE HOUSING STRUCTURE

(71) Applicant: Trane International Inc., Piscataway, NJ (US)

(72) Inventors: Andrew Hamilton Hanks, Tyler, TX (US); Richard Lee Jameson, Tyler, TX (US); Jeffrey Lee Stewart, Whitehouse, TX (US)

(73) Assignee: Trane International Inc., Davidson, NC (US)

( * ) Notice: Subject to any disclaimer, the term of this patent is extended or adjusted under 35 U.S.C. 154(b) by 532 days.

(21) Appl. No.: 14/680,799

(22) Filed: Apr. 7, 2015

(65) Prior Publication Data

US 2015/0285516 A1 Oct. 8, 2015

Related U.S. Application Data

(60) Provisional application No. 61/976,331, filed on Apr. 7, 2014.

(51) Int. Cl.
*H02G 3/10* (2006.01)
*F24F 13/20* (2006.01)

(52) U.S. Cl.
CPC ..... *F24F 13/20* (2013.01); *Y10T 29/49826* (2015.01)

(58) Field of Classification Search
CPC ..... H02G 3/08; H02G 3/081; H02G 3/086; H02G 3/14
USPC .... 220/3.2, 3.3, 3.8, 3.9, 3.92, 3.94; 174/50, 174/67
See application file for complete search history.

(56) References Cited

U.S. PATENT DOCUMENTS 3,106,602 A * 10/1963 Hartz ..... H02G 3/14 174/60
3,434,618 A * 3/1969 MacDonald ..... H01R 13/6395 174/67
5,280,135 A * 1/1994 Berlin ..... H02G 3/14 174/67
5,621,192 A * 4/1997 Bordwell ..... H02G 3/14 174/67
6,727,429 B1 * 4/2004 Koessler ..... H02G 3/088 174/50
7,217,308 B2 * 5/2007 Thanheiser ..... B01D 46/0004 123/198 E
2005/0082081 A1 * 4/2005 Marcou ..... H02G 3/088 174/67
2005/0257949 A1 * 11/2005 Lalouette ..... G06F 1/184 174/50
2010/0078189 A1 * 4/2010 Leopold ..... H02G 3/088 174/50.5
2012/0255759 A1 * 10/2012 Pullium, III ..... H01R 4/70 174/50

* cited by examiner

*Primary Examiner* — Allan D Stevens
(74) *Attorney, Agent, or Firm* — Womble Bond Dickinson (US) LLP

(57) ABSTRACT

A protective housing structure for a heating, ventilation, and air conditioning (HVAC) system includes a first end and a second end with a centerline extending there between. The protecting housing structure includes a cover section that is located between the first end and second end. The cover section includes a dome-shaped top panel that is rigidly attached to a first sidewall and a second sidewall.

14 Claims, 26 Drawing Sheets

PROTECTIVE HOUSING STRUCTURE

CROSS-REFERENCE TO RELATED APPLICATIONS

The present application claims priority under 35 U.S.C. 119(e) to U.S. Provisional Patent Application No. 61/976,331 filed on Apr. 7, 2014 by Hanks, et al., and entitled "Protective Housing Structure," the disclosure of which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems may generally be used in residential and/or commercial areas for heating and/or cooling to create comfortable temperatures inside those areas. HVAC systems may generally be capable of cooling a comfort zone by operating in a cooling mode for transferring heat from a comfort zone to an ambient zone using a refrigeration cycle, and in some cases the HVAC system may be capable of reversing the direction of refrigerant flow through the components of the HVAC system so that heat is transferred from the ambient zone to the comfort zone, thereby heating the comfort zone. To manage the flow of air between the comfort zone and ambient zone, some HVAC systems may have an air handler component that operates in the regulation, circulation, and conditioning of air.

SUMMARY

In an embodiment, a protective housing structure for an HVAC system is disclosed. The protective housing structure includes a first end and second end with a centerline extending there between. The protective housing may also comprise a cover section located between the first and second ends. The cover section may comprise a dome-shaped top panel that is rigidly attached to a first sidewall and a second sidewall.

An embodiment of an HVAC system is disclosed that comprises a double-walled cabinet and a shroud. The double-walled cabinet has an at least one exterior wall and an interior wall. The at least one exterior wall and the interior wall are configured to form a wall cavity that is at least partially bound by each of the exterior wall and the interior wall. The shroud comprises a plurality of walls that are rigidly attached to a dome-shaped cover having a planar surface at or near an apex of the dome-shaped cover. The shroud may be at least partially within the wall cavity and may be attached to an exterior wall or an interior wall of the double-walled cabinet.

An alternative HVAC system is disclosed that may comprise a cabinet, a sealable enclosure, a control component, and an insulation material. The cabinet may have at least one wall comprising an interior shell and an exteriors skin associated with the interior shell that is configured to form a wall space that is at least partially bound by each of the interior shell and the exterior skin; the at least one wall being so configured as to at least partially defined a fluid duct of the cabinet. At least a portion of the sealable enclosure may be rigidly attached with the inner shell of the cabinet. The control component may be at least partially disposed within the wall space and the sealable enclosure. Additionally, the insulation is disposed within the wall space and is configured to prevent airflow through at least part of the wall space.

An additional embodiment discloses a method for protecting components of a HVAC system. The method comprises rigidly attaching a shroud to an interior wall of a double-walled cabinet. The double-walled cabinet may have at least one exterior wall and an interior wall. The at least one exterior wall and the interior wall may be disposed in such a way as to form a wall cavity that is at least partially bound by each of the exterior wall and the interior wall. The shroud may be a unitary skin structure comprising a plurality of walls and a dome-shaped top cover. The dome-shaped top cover may include a planar surface at or near an apex of the dome-shaped top cover. The shroud may be located within the wall cavity of the double-walled cabinet, and the shroud is configured to define an opening between the plurality of walls and beneath the dome-shaped top cover, the opening being configured to receive a control component. The method may also comprise resisting a compressive force using the shroud.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

Figure 1:
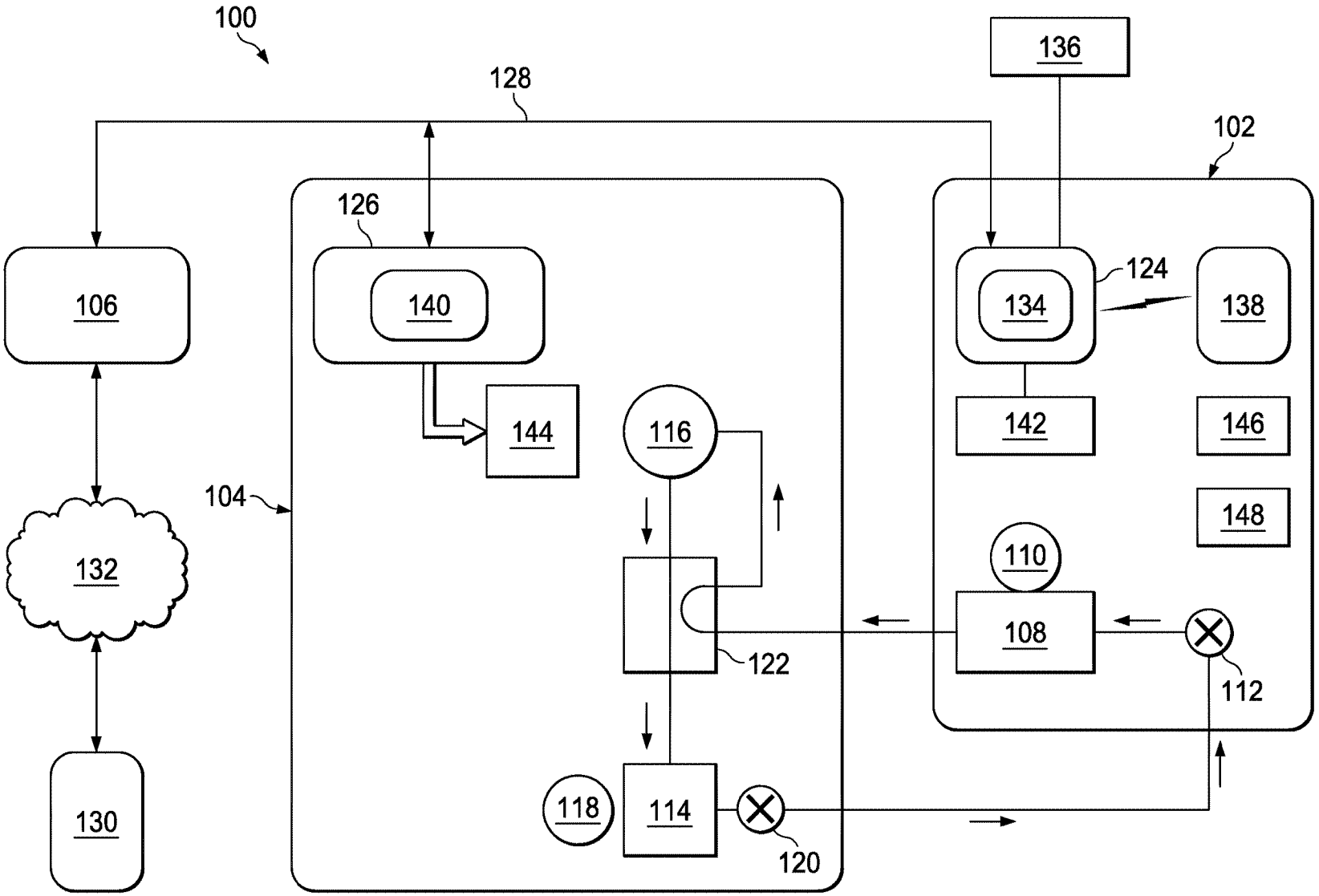
FIG. 1 is a schematic diagram of an exemplary HVAC system according to a disclosed embodiment.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

In the modern market place of HVAC systems, clients expect systems to perform as intended and prefer to minimize down-time when a component of the HVAC system requires maintenance. Mitigating and/or preventing failures yields higher customer satisfaction and faster device maintenance, thereby increasing profit margins. Because HVAC systems increasingly use electrical components (e.g., a circuit board and/or other control device mounted on a control panel), the sensitive nature of some of these components makes them susceptible to degraded performance when they are exposed to temperature gradients, changes in humidity, air contaminates, environmental factors, and in some cases, may lead to premature failure in response to exposures and/or application of applied forces. Thus, mitigating and/or preventing failures from external exposures and/or applied forces during and/or after construction and installation may allow for more reliable operation of the overall HVAC system and quicker maintenance of internal components.

Thus, the present disclosure teaches a protective housing structure—and system and method for implementation—that protects components of an HVAC system from exposure to negative environmental elements. Specifically, the protective housing structure may maintain its structural integrity upon the application of a predetermined amount of externally applied force (e.g. loads from an injected expanding foam insulation material) such that the force does not collapse or deform the protective housing structure and damage sensitive components disposed therein. Structural failure and inadequate protection from environmental elements can lead to increased cost for replacing parts or in some situations, replacing an entire unit of the HVAC system because the failure may not be repairable. However, protecting internal components should be balanced with allowing the surrounding environment to perform its intended function—such as injected expanding foam providing a generally continuous thermal conductive barrier without substantial voids or gaps in insulating material.

In an embodiment, a protective housing structure comprises a plurality of side walls and a dome-shaped top panel that may have a planar surface at or near the panel's apex. The protective housing structure may be configured so as to allow the placement of proximate objects (e.g., surrounding insulation material) without causing voids or irregularities in the proximate object's placement. For example, the dome-shaped top panel may allow for injection of expanding foam from one side of the protective housing structure and the protective housing structure does not impede the expanding foam from filling an area proximate to the protective housing structure. The protective housing structure may include a sealing section with a channel that is open at one end that is configured to allow expanding foam to exit the channel and surround an area proximate to the protective housing structure that is opposite from where expanding foam was injected. Furthermore, the planar surface of the dome-shaped top panel may be configured to distribute forces from insulation material away from the top panel. In some embodiments, the dome-shaped top panel may be configured to be a monocoque structure, that is a structure that supports most and/or all applied loads through the outer skin, similar to an egg shell. This allows applied forces to be distributed towards edge portions of the protective housing structure, which may flex and/or materially deflect a predefined distance and/or angle so as to form a seal between the protective housing structure and an adjacent wall or proximate surface. The protective housing structure may be manufactured as one unitary piece, such as through injection molding, thereby minimizing individual parts that may increase the cost of production. A unitary structure may also ensure that the protective housing structure forms a seal with a proximate surface (e.g., a walls of cabinet in an HVAC system), thus sealing the protective housing structure's inner surfaces and components (e.g. control panel) from the external environment.

Turning now to FIG. 1, a simplified schematic diagram of an exemplary HVAC system 100 is shown according to an embodiment of the disclosure. In this embodiment, HVAC system 100 may comprise an indoor unit 102, an outdoor unit 104, and a system controller 106. In some embodiments, the HVAC system 100 may also comprise a generator and a generator fluid circuit that is contained within the outdoor unit 104. The system controller 106 may control operation of the indoor unit 102 and/or the outdoor unit 104. As shown, the HVAC system 100 may also be known as a heat pump system that may be selectively operated to implement one or more substantially closed thermodynamic refrigeration cycles to provide a cooling functionality and/or a heating functionality. It is understood that a double-walled cabinet design (as disclosed hereafter) may be incorporated in any of the indoor unit 102, outdoor unit 104, or other generally known housing units of an HVAC system, such as an air handling unit (AHU) 100 as disclosed in FIGS. 5A-5C.

In an embodiment, indoor unit 102 may comprise an indoor heat exchanger 108, an indoor fan 110, and an indoor metering device 112. Some embodiments of indoor unit 102 may include a double walled cabinet, such as the air handling unit (AHU) 100 as disclosed in FIGS. 5A-5C. Indoor heat exchanger 108 may include a plate fin heat exchanger configured to allow heat exchange between refrigerant carried within internal tubing of the indoor heat exchanger 108 and fluids that contact the indoor heat exchanger 108 but that are kept segregated from the refrigerant. In other embodiments, indoor heat exchanger 108 may comprise a spine fin heat exchanger, a microchannel heat exchanger, or any other suitable type of heat exchanger. In some embodiments, indoor unit 102 may include a protective housing structure, enclosure, and/or shroud 146 that may be configured to define an opening that may at least partially encapsulate a control assembly 148. The protective housing structure 146 may include embodiments disclosed in at least FIGS. 2A-2R, and may separate insulation material, contaminants, fluids, for example, from the opening defined by the protective structure. Additionally, control assembly 148 may include HVAC control components or electrical boards, such as indoor fan controller 144 and/or indoor controller 124, or embodiments as disclosed in FIGS. 3A-3D.

In an embodiment, the indoor fan 110 is a centrifugal blower comprising a blower housing, a blower impeller at least partially disposed within the blower housing, and a blower motor configured to selectively rotate the blower impeller. In other embodiments, the indoor fan 110 may comprise a mixed-flow fan and/or any other suitable type of fan. The indoor fan 110 may be configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, the indoor fan 110 may be a single speed fan.

In an embodiment, the indoor metering device 112 is an electronically controlled motor driven electronic expansion valve (EEV). In alternative embodiments, the indoor metering device 112 may comprise a thermostatic expansion valve, a capillary tube assembly, and/or any other suitable metering device. The indoor metering device 112 may comprise and/or be associated with a refrigerant check valve and/or refrigerant bypass for use when a direction of refrigerant flow through the indoor metering device 112 is such that the indoor metering device 112 is not intended to meter or otherwise substantially restrict flow of the refrigerant through the indoor metering device 112.

In an embodiment, outdoor unit 104 comprises an outdoor heat exchanger 114, a compressor 116, an outdoor fan 118, an outdoor metering device 120, and a reversing valve 122. Outdoor heat exchanger 114 is a spine fin heat exchanger configured to allow heat exchange between refrigerant carried within internal passages of the outdoor heat exchanger 114 and fluids that contact the outdoor heat exchanger 114 but that are kept segregated from the refrigerant. In other embodiments, outdoor heat exchanger 114 may comprise a plate fin heat exchanger, a microchannel heat exchanger, or any other suitable type of heat exchanger.

In an embodiment, the compressor 116 is a multiple speed scroll type compressor configured to selectively pump refrigerant at a plurality of mass flow rates. In alternative embodiments, the compressor 116 may comprise a modulating compressor capable of operation over one or more speed ranges, a reciprocating type compressor, a single speed compressor, and/or any other suitable refrigerant compressor and/or refrigerant pump.

In an embodiment, the outdoor fan 118 is an axial fan comprising a fan blade assembly and fan motor configured to selectively rotate the fan blade assembly. In other embodiments, the outdoor fan 118 may comprise a mixed-flow fan, a centrifugal blower, and/or any other suitable type of fan and/or blower. The outdoor fan 118 may be configured as a modulating and/or variable speed fan capable of being operated at many speeds over one or more ranges of speeds. In other embodiments, the outdoor fan 118 may be configured as a multiple speed fan capable of being operated at a plurality of operating speeds by selectively electrically powering different ones of multiple electromagnetic windings of a motor of the outdoor fan 118. In yet other embodiments, the outdoor fan 118 may be a single speed fan.

In an embodiment, the outdoor metering device 120 is a thermostatic expansion valve. In alternative embodiments, the outdoor metering device 120 may comprise an electronically controlled motor driven EEV similar to indoor metering device 112, a capillary tube assembly, and/or any other suitable metering device. The outdoor metering device 120 may comprise and/or be associated with a refrigerant check valve and/or refrigerant bypass for use when a direction of refrigerant flow through the outdoor metering device 120 is such that the outdoor metering device 120 is not intended to meter or otherwise substantially restrict flow of the refrigerant through the outdoor metering device 120.

In an embodiment, the reversing valve 122 is a so-called four-way reversing valve. The reversing valve 122 may be selectively controlled to alter a flow path of refrigerant in the HVAC system 100 as described in greater detail below. The reversing valve 122 may comprise an electrical solenoid or other device configured to selectively move a component of the reversing valve 122 between operational positions.

In an embodiment, the system controller 106 may comprise a touchscreen interface for displaying information and for receiving user inputs, which may be accomplished by the use of an application stored in a non-transitory memory and executed on a processor. The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. In some embodiments, the system controller 106 may not comprise a display and may derive all information from inputs, remote sensors, and remote configuration tools. In some embodiments, the system controller 106 may comprise a temperature sensor and may further be configured to control heating and/or cooling of zones associated with the HVAC system 100. In some embodiments, the system controller 106 may be configured as a thermostat for controlling supply of conditioned air to zones associated with the HVAC system 100.

In some embodiments, the system controller 106 may also selectively communicate with an indoor controller 124 of the indoor unit 102, with an outdoor controller 126 of the outdoor unit 104, and/or with other components of the HVAC system 100. The system controller 106 may be configured for selective bidirectional communication over a communication bus 128. Portions of the communication bus 128 may comprise a three-wire connection suitable for communicating messages between the system controller 106 and one or more of the HVAC system 100 components configured for interfacing with the communication bus 128.

Still further, the system controller 106 may be configured to selectively communicate with HVAC system 100 components and/or any other device 130 via a communication network 132. In some embodiments, the communication network 132 comprises a telephone network, and the other device 130 may comprise a communication device (e.g., a landline or mobile telephone). The communication network 132 may comprise a public and/or private network (e.g., the Internet), and the other device 130 may comprise a communication device and/or mobile communication device, either of which may include capabilities for network communication (e.g., a smartphone capable of connection to the internet or another mobile device). Some embodiments of the communication network 132 may also comprise a remote server, including a processor and a non-transitory memory.

In an embodiment, the indoor controller 124 may be carried, housed, enclosed, and/or protected by the indoor unit 102 and may be configured to receive information inputs, transmit information outputs, and otherwise communicate with the system controller 106, the outdoor controller 126, and/or any other device 130 via the communication bus 128 and/or any other suitable medium of communication. Exemplary embodiments of an indoor controller 124 may include embodiments disclosed in FIGS. 3A-3D as explained above. In some embodiments, the indoor controller 124 may be configured to communicate with an indoor personality module 134 that may comprise information related to the identification and/or operation of the indoor unit 102. The indoor controller 124 may be configured to receive information related to a speed of the indoor fan 110, transmit a control output to an electric heat relay, transmit information regarding an indoor fan 110 volumetric flowrate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. The indoor personality module 134 may comprise information related to the identification and/or operation of the indoor unit 102 and/or a position of the outdoor metering device 120.

In some embodiments, the indoor EEV controller 138 may be configured to receive information regarding temperatures and/or pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112. The indoor EEV controller 138 may also be configured to communicate with the outdoor metering device 120 and/or otherwise affect control over the outdoor metering device 120.

In an embodiment, the outdoor controller 126 may be carried, housed, enclosed, and/or protected by the outdoor unit 104 and may be configured to receive information inputs, transmit information outputs, and otherwise communicate with the system controller 106, the indoor controller 124, and/or any other device via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. The outdoor controller 126 may also be configured to transmit information related to monitoring, communicating with, and/or otherwise affecting control over the outdoor fan 118, a compressor sump heater, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with a compressor drive controller 144 that is configured to electrically power and/or control the compressor 116.

The HVAC system 100 is shown configured for operating in a mode for cooling (i.e., colloquially known as a cooling mode) in which heat is absorbed by refrigerant at the indoor heat exchanger 108 and heat is rejected from the refrigerant at the outdoor heat exchanger 114. In some embodiments, the compressor 116 may be operated to compress refrigerant and pump the relatively high temperature and high pressure compressed refrigerant from the compressor 116 to the outdoor heat exchanger 114 through the reversing valve 122 and to the outdoor heat exchanger 114. As the refrigerant is passed through the outdoor heat exchanger 114, the outdoor fan 118 may be operated to move fluid (e.g., air) into contact with the outdoor heat exchanger 114, thereby transferring heat from the refrigerant to the fluid (e.g., air) surrounding the outdoor heat exchanger 114. The refrigerant may primarily comprise liquid phase refrigerant and the refrigerant may flow from the outdoor heat exchanger 114 to the indoor metering device 112 through and/or around the outdoor metering device 120 which does not substantially impede flow of the refrigerant in the cooling mode. The indoor metering device 112 may meter passage of the refrigerant through the indoor metering device 112 so that the refrigerant downstream of the indoor metering device 112 is at a lower pressure than the refrigerant upstream of the indoor metering device 112. The pressure differential across the indoor metering device 112 allows the refrigerant downstream of the indoor metering device 112 to expand and/or at least partially convert to a two-phase (vapor and gas) mixture. The two phase refrigerant may enter the indoor heat exchanger 108. As the refrigerant is passed through the indoor heat exchanger 108, the indoor fan 110 may be operated to move fluid (e.g., air) into contact with the indoor heat exchanger 108, thereby transferring heat to the refrigerant from the fluid (e.g., air) surrounding the indoor heat exchanger 108, and causing evaporation of the liquid portion of the two phase mixture. The refrigerant may thereafter re-enter the compressor 116 after passing through the reversing valve 122.

In some embodiments, the HVAC system 100 may operate in a mode for heating (i.e., a heating mode). In this embodiment, the reversing valve 122 may be controlled to alter the flow path of the refrigerant, the indoor metering device 112 may be disabled and/or bypassed, and the outdoor metering device 120 may be enabled. In the heating mode, refrigerant may flow from the compressor 116 to the indoor heat exchanger 108 through the reversing valve 122, the refrigerant may be substantially unaffected by the indoor metering device 112, the refrigerant may experience a pressure differential across the outdoor metering device 120, the refrigerant may pass through the outdoor heat exchanger 114, and the refrigerant may reenter the compressor 116 after passing through the reversing valve 122. Most generally, operation of the HVAC system 100 in the heating mode reverses the roles of the indoor heat exchanger 108 and the outdoor heat exchanger 114 as compared to their operation in the cooling mode as described in the present disclosure.

Portions of the embodied HVAC system 100 and/or components therein, may comprise insulation material that acts as a thermal barrier to minimize heat transfer between designated areas. For example, an insulation material may be disposed within a wall space or other cavity of an HVAC system component such that the insulation material at least partially encapsulates an outer surface, such as any of a protective housing structure, shroud, or sealable enclosure as discussed in FIGS. 2A-2R. The insulation material may prevent fluid flow (such as air flow) through at least part of a component, such as a cavity or wall space of a cabinet, because the insulation material may at least partially fill the wall cavity or space. It is understood that insulation material may comprise a variety of forms and shapes. In an embodiment, insulation material may include expanding foam insulation that may comprise any of open cell foam insulation or closed cell foam insulation. Some insulation may comprise polyurethane, which may take the form of a spray foam. In some embodiments, a method of insulating an HVAC system 100 may include inserting and/or injecting insulation material. Where the insulation comprises an expanding foam, the insulation material may expand at a designated volumetric rate, and may apply a force when coming in at least partial contact with and/or encapsulate a component of the HVAC system 100, such as a protective housing structure, shroud, and/or sealable enclosure as disclosed in FIGS. 2A-2R. In some embodiments, the insulation material may be configured to resist adhesion to materials (and/or components comprising materials) that are polar in nature.

Figure 2A:
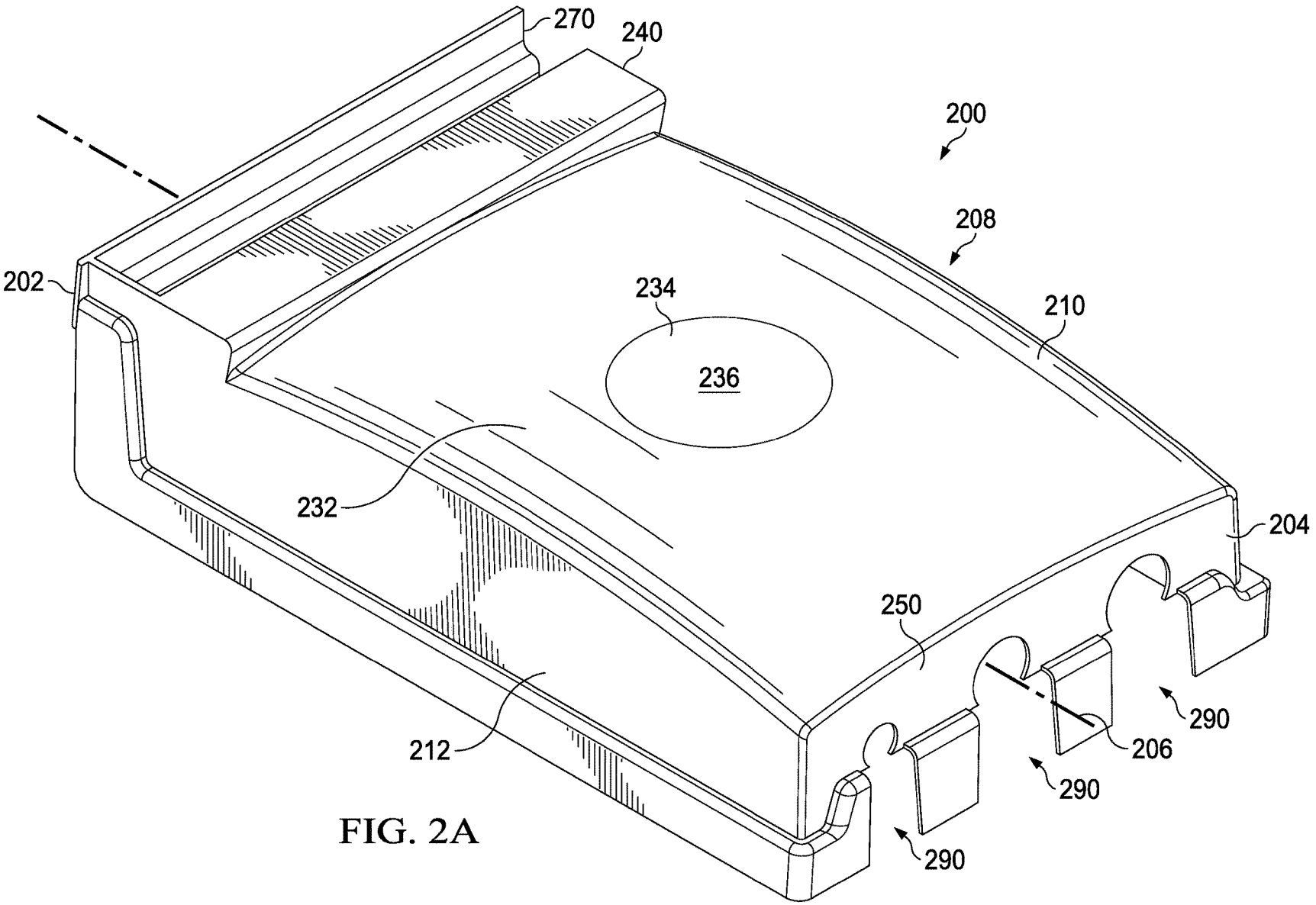
FIG. 2A is an orthogonal view of an embodiment of a protective housing structure.
Figure 2B:
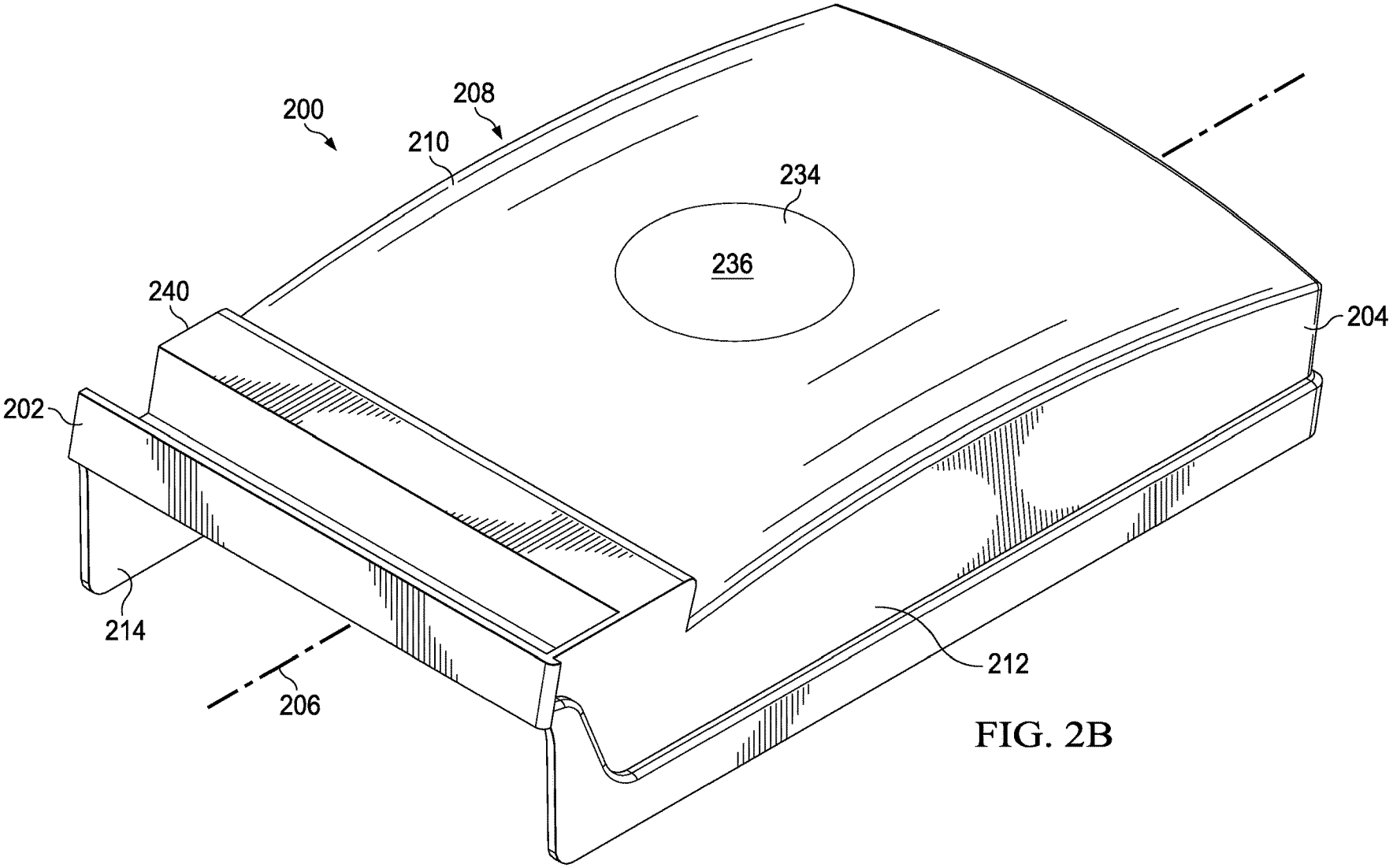
FIG. 2B is an alternative orthogonal view similar to FIG. 2A.
Figure 2C:
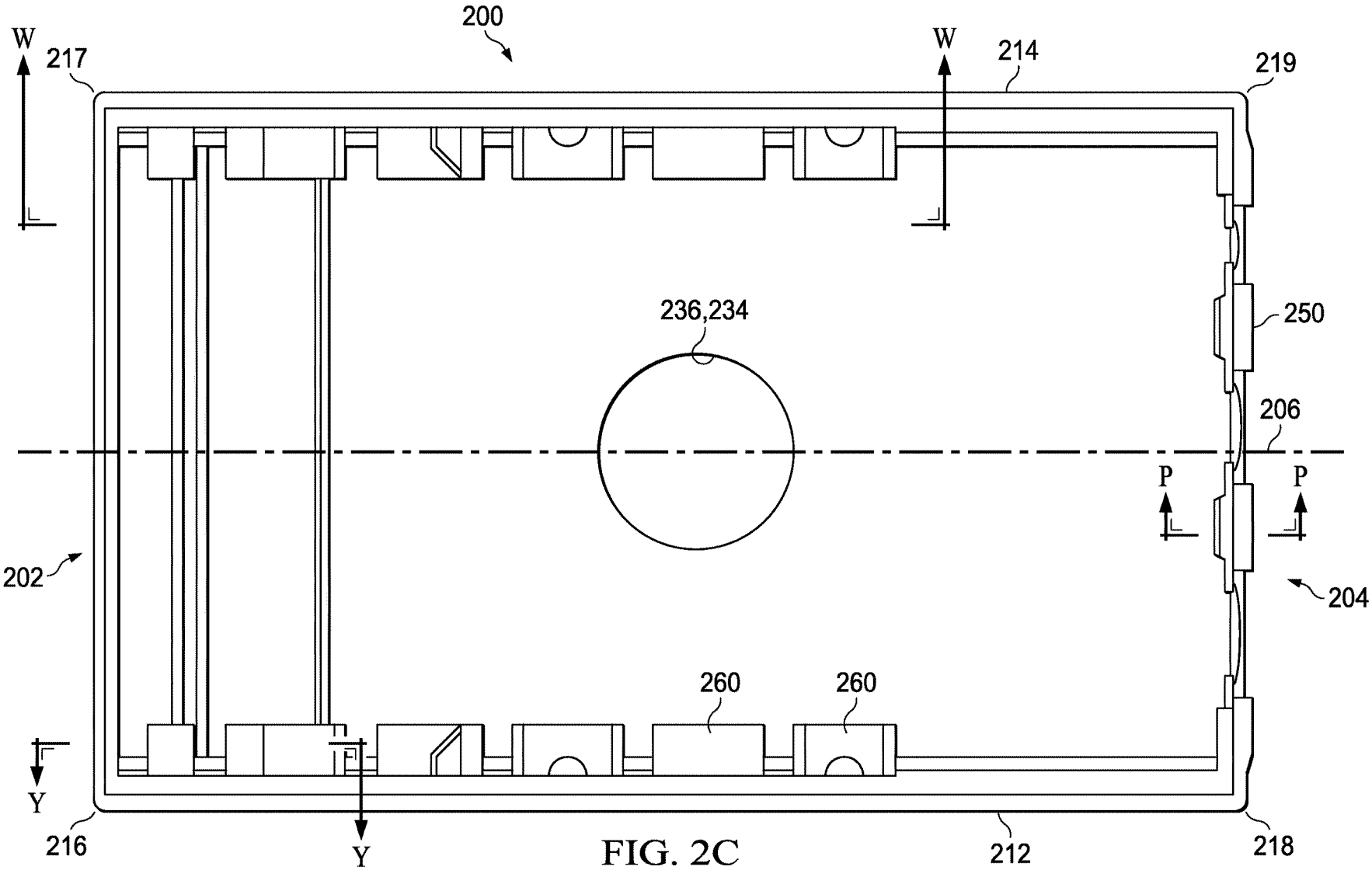
FIG. 2C is top view of an exemplary protective housing structure similar to FIG. 2A.
Figure 2D:
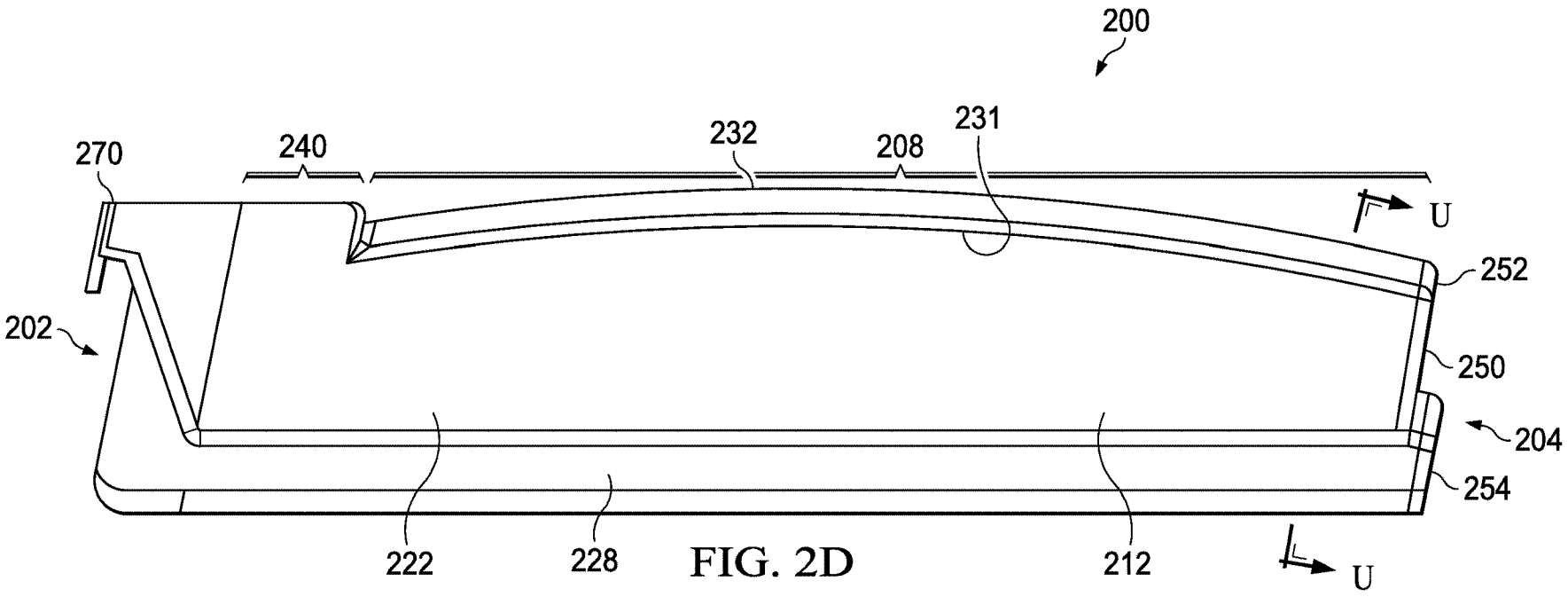
FIG. 2D is a side view of the protective housing structure of FIG. 2C.
Figure 2E:
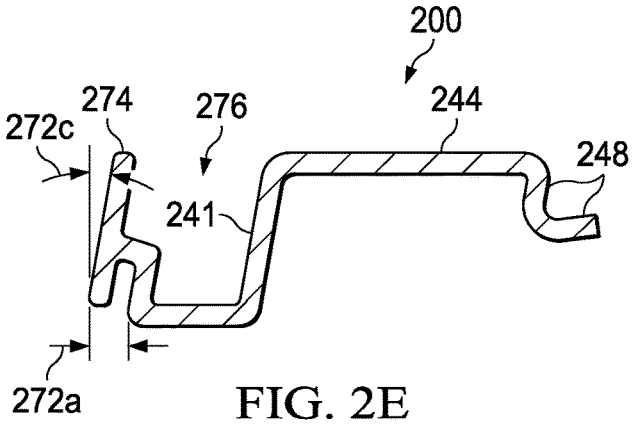
FIG. 2E is a cross-sectional view taken along line V-V of FIG. 2C.
Figure 2F:
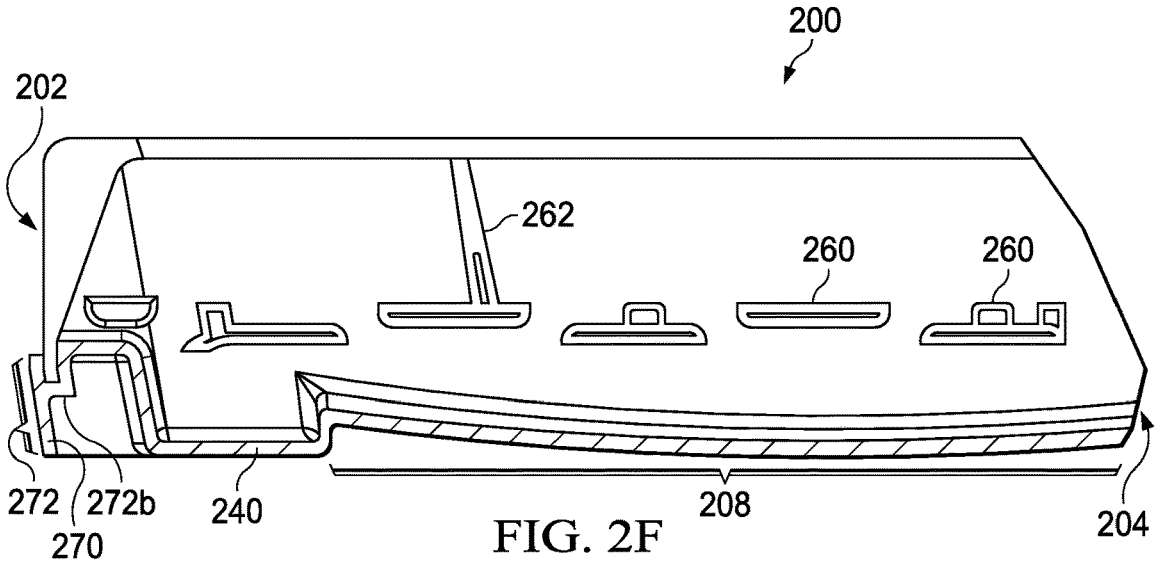
FIG. 2F is a cross-sectional view taken along line W-W of FIG. 2C.
Figure 2G:
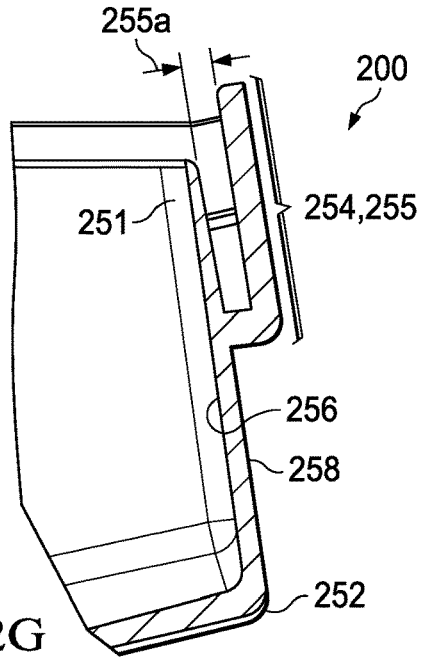
FIG. 2G is a cross-sectional view taken along line P-P of FIG. 2C.
Figure 2H:
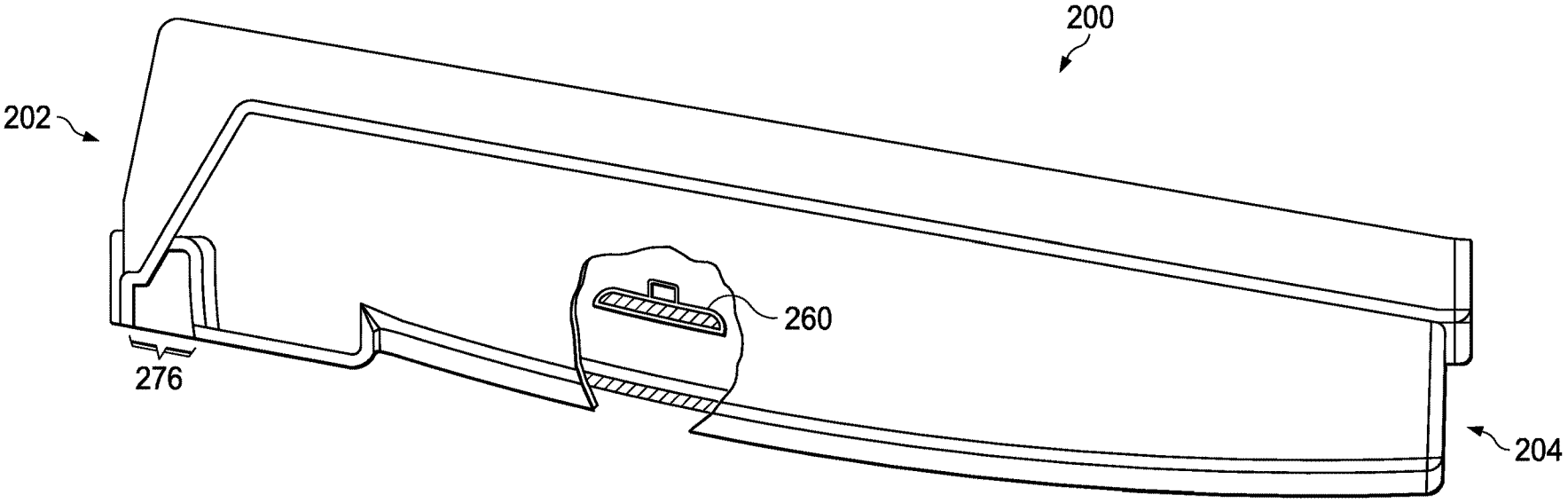
FIG. 2H is a rotated cutaway side of FIG. 2D showing a cross-sectional view along line R-R of FIG. 2I.
Figure 2I:
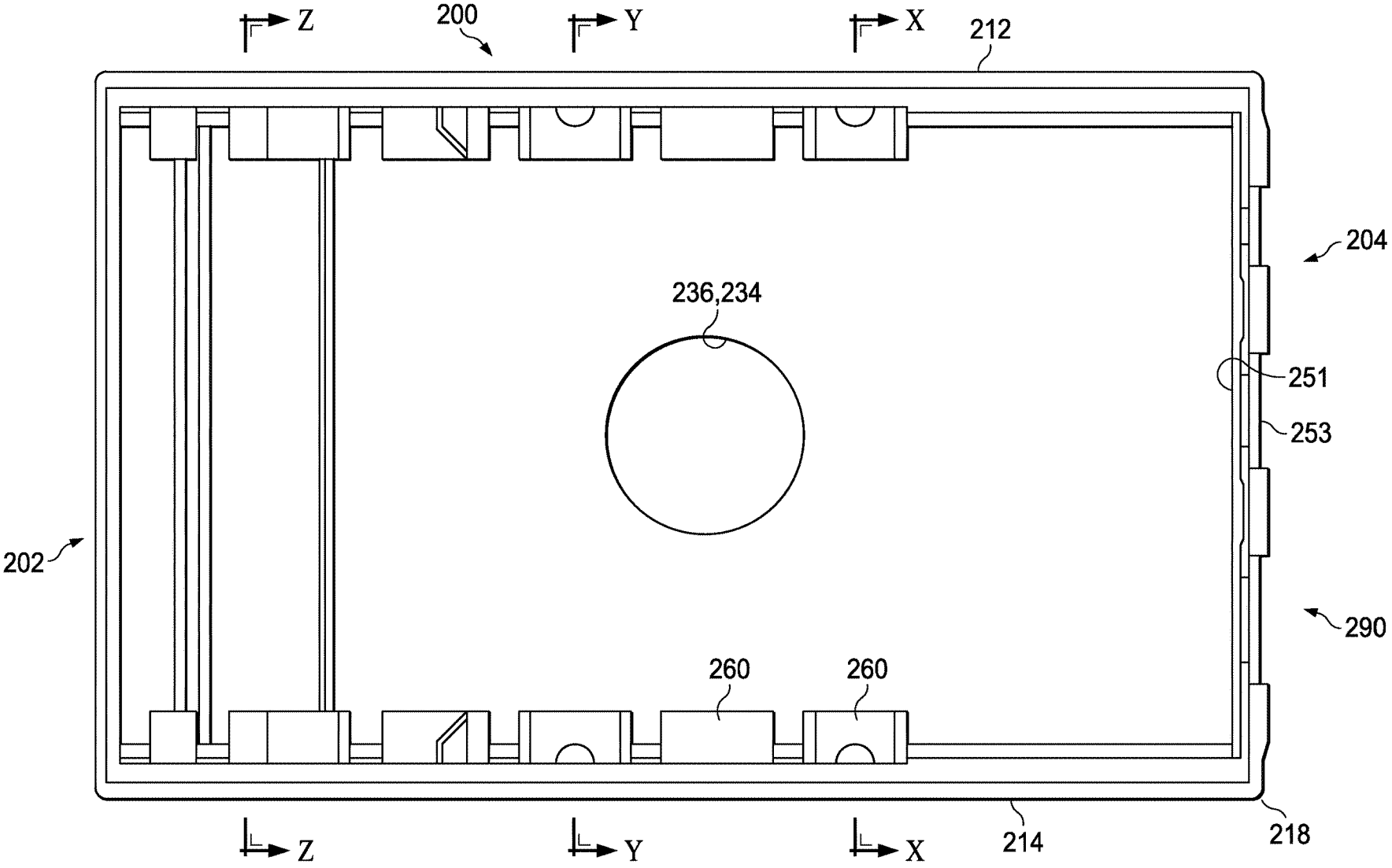
FIG. 2I is a bottom view of the exemplary protective housing of FIG. 2C.
Figure 2J:
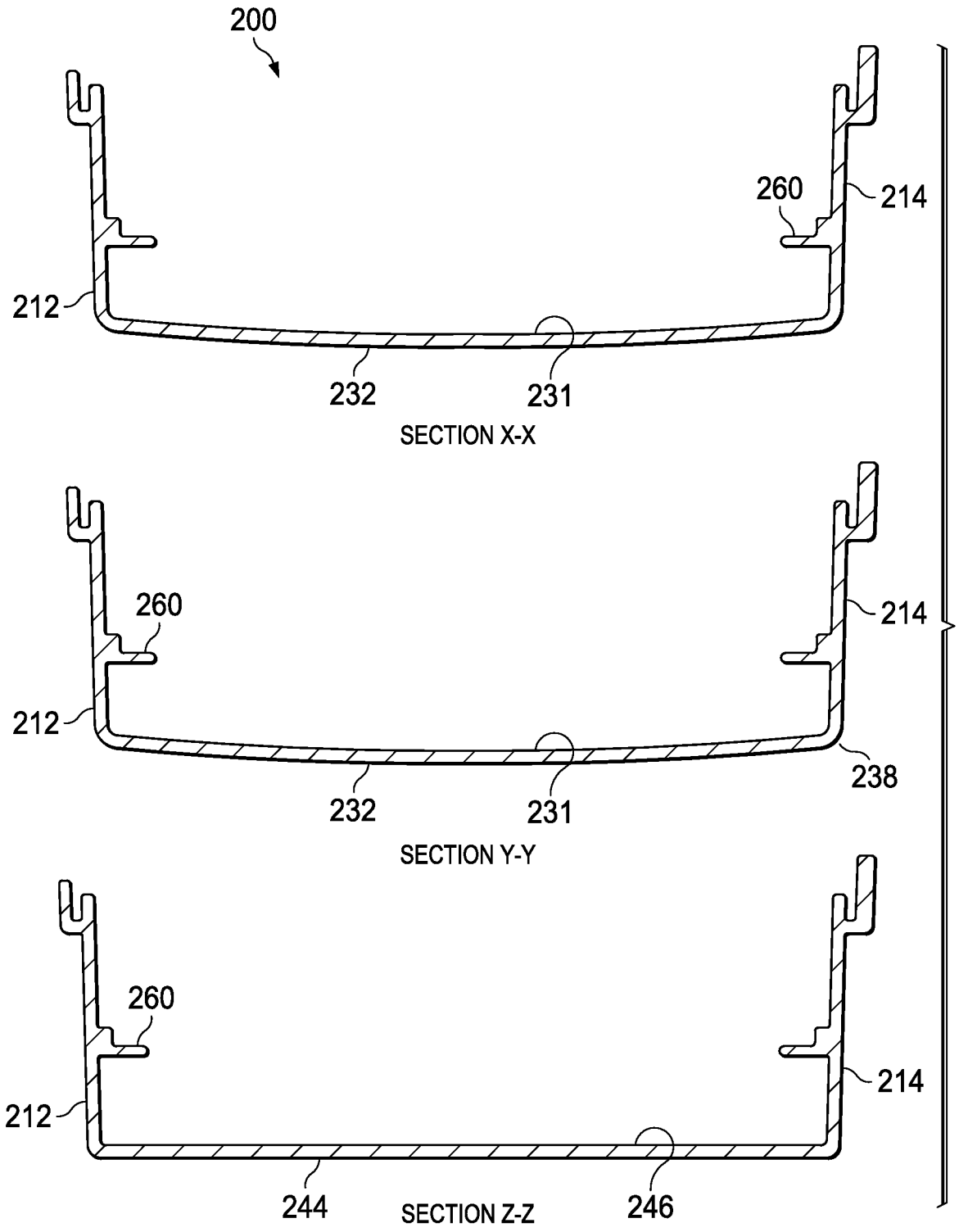
FIG. 2J is a plurality of rotated cross-sectional views taken along lines X-X, Y-Y, and Z-Z of FIG. 2I.
Figure 2K:
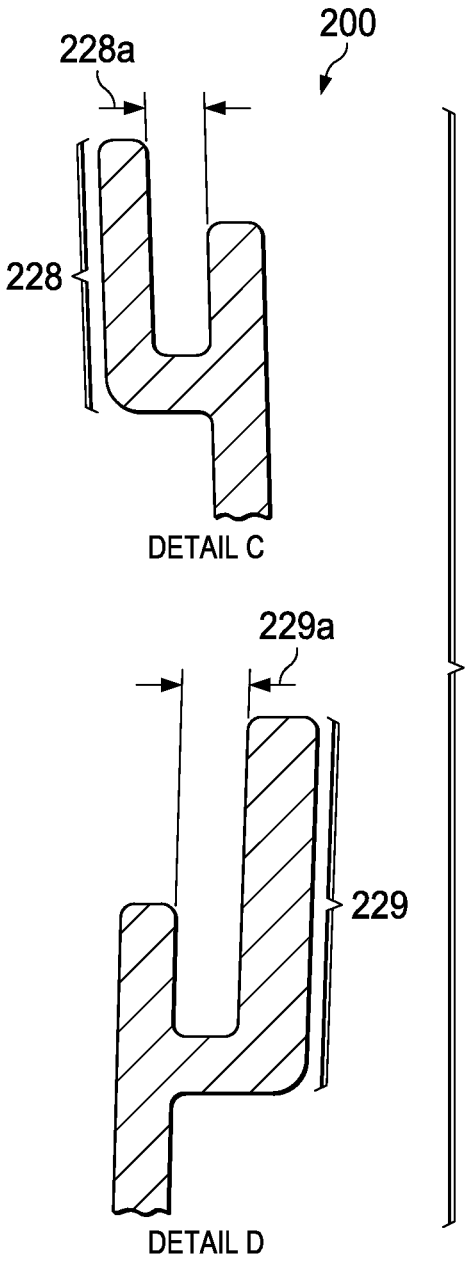
FIG. 2K is a cross-sectional view of details C and D along cross section Z-Z of FIG. 2J.
Figure 2L:
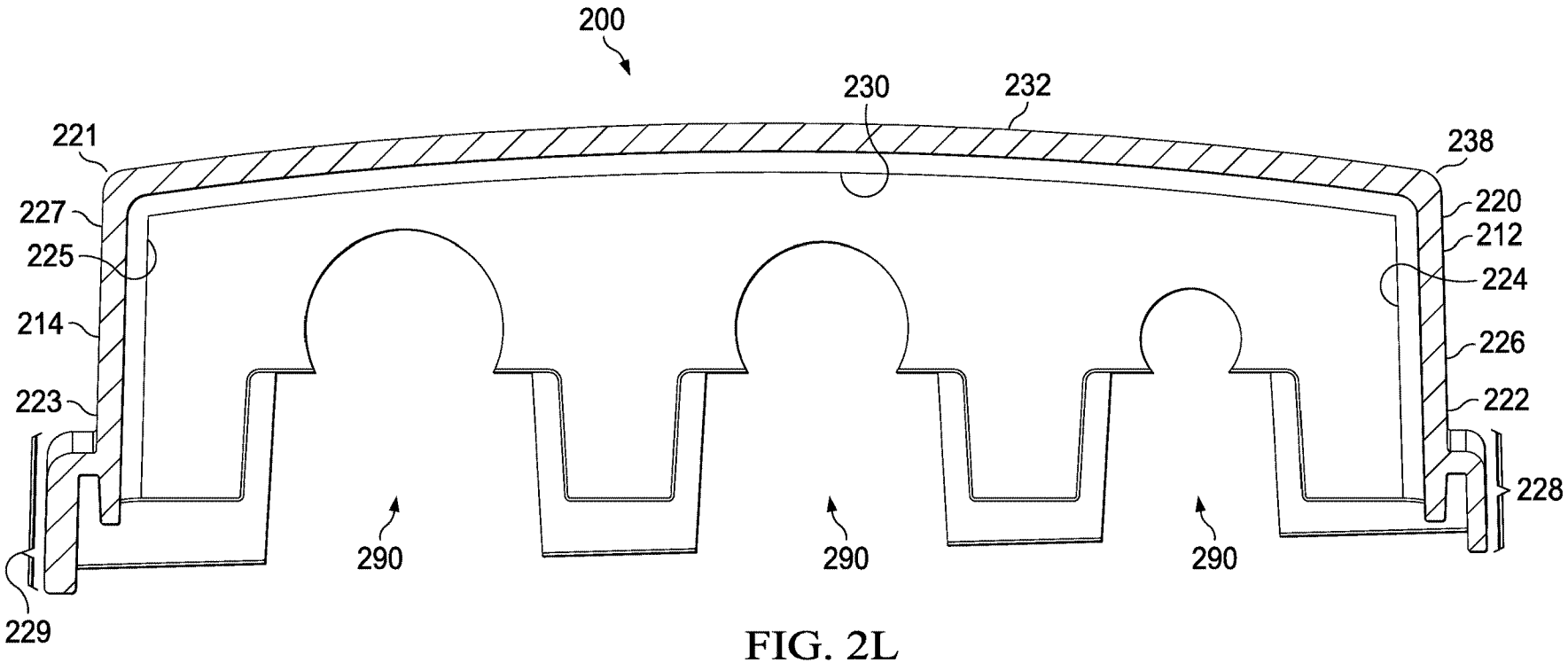
FIG. 2L is a cross-sectional view taken along line U-U of FIG. 2D.
Figure 2M:
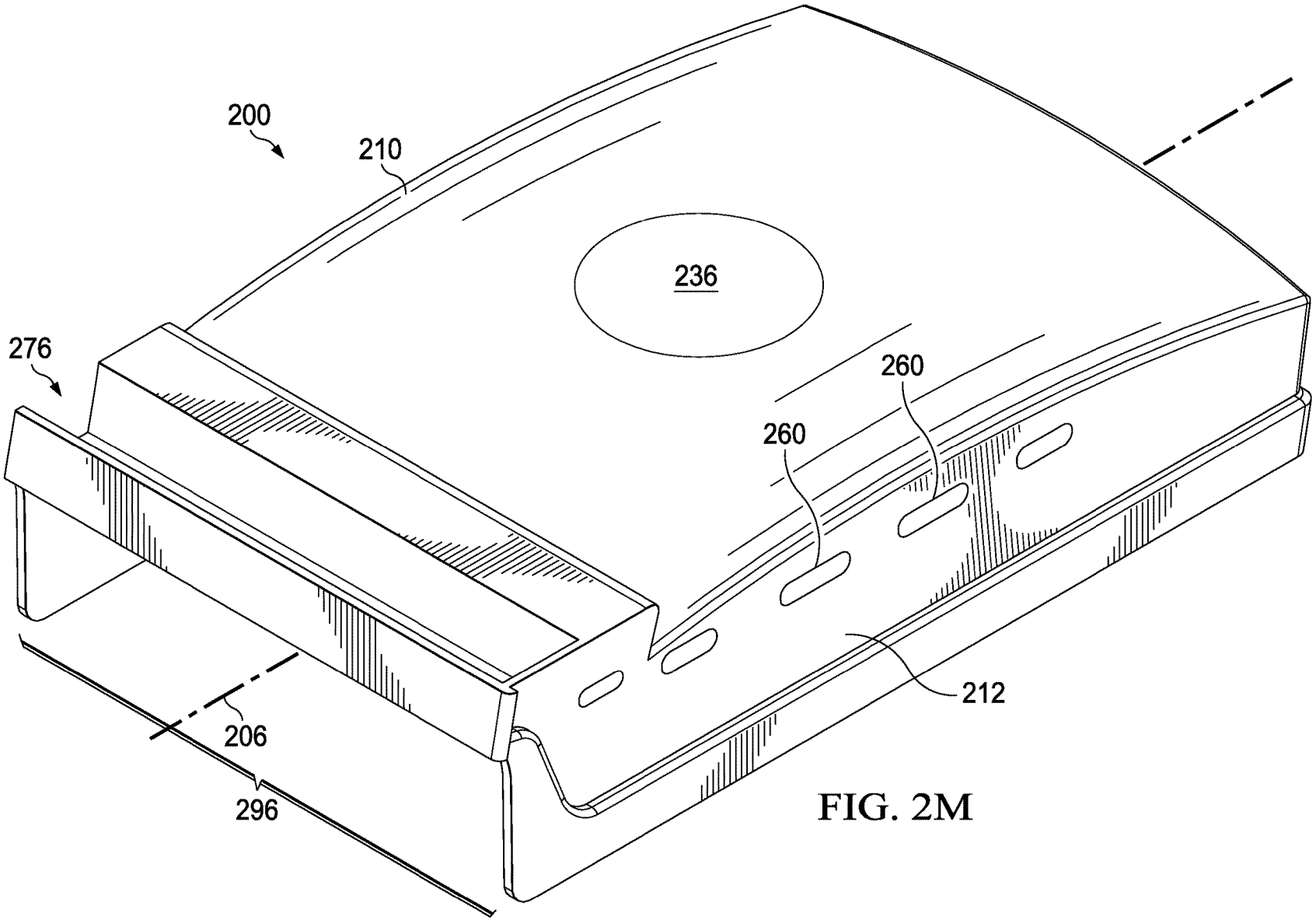
FIG. 2M is an orthogonal view similar to FIG. 2A.
Figure 2N:
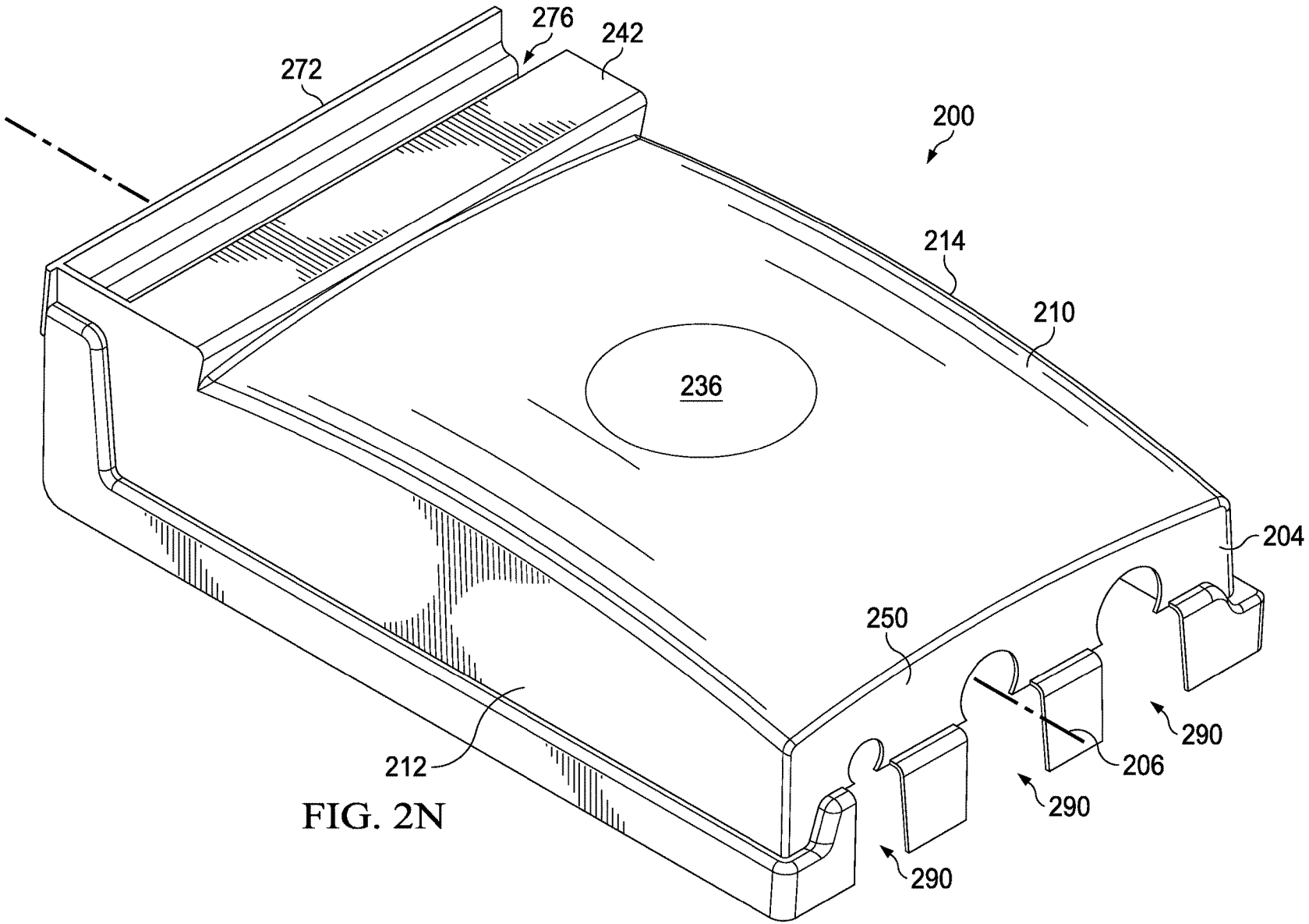
FIG. 2N is an alternative orthogonal view similar to FIG. 2B.
Figure 2O:
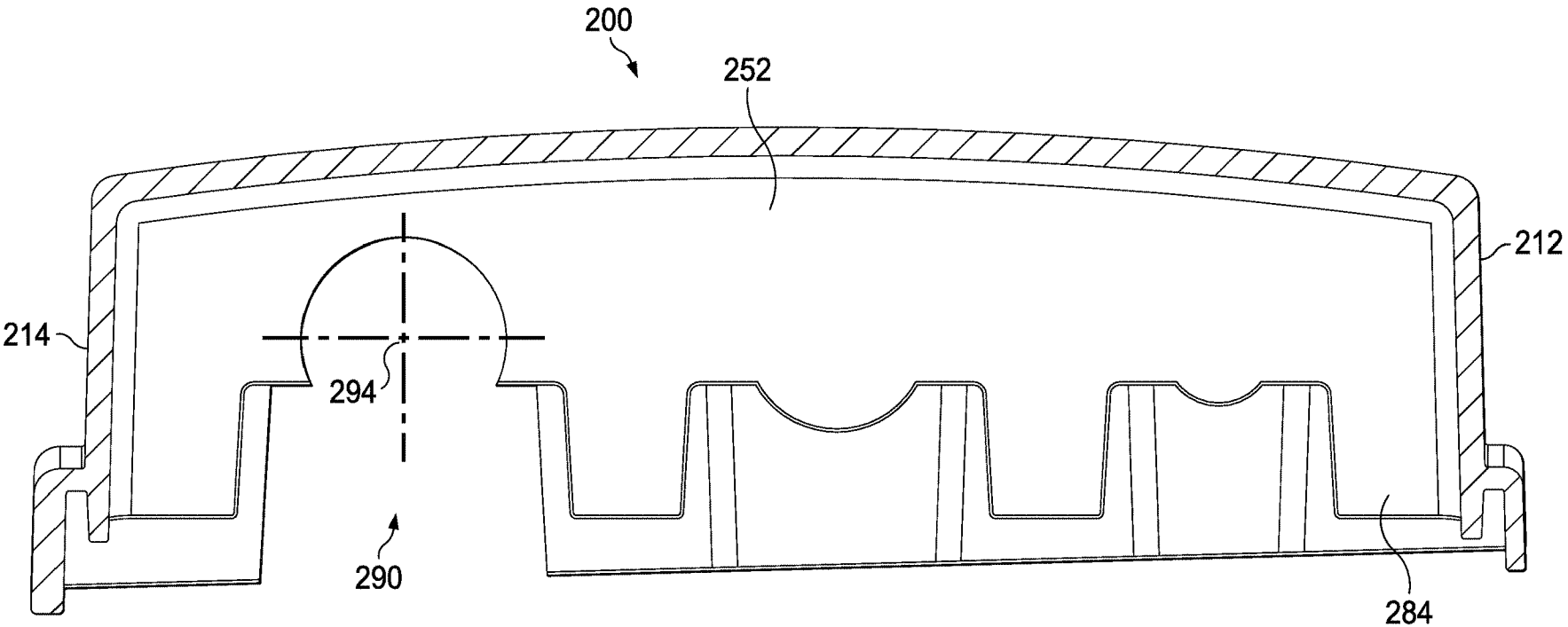
FIG. 2O is an alternative cross-sectional view taken along line U-U of FIG. 2D.
Figure 2P:
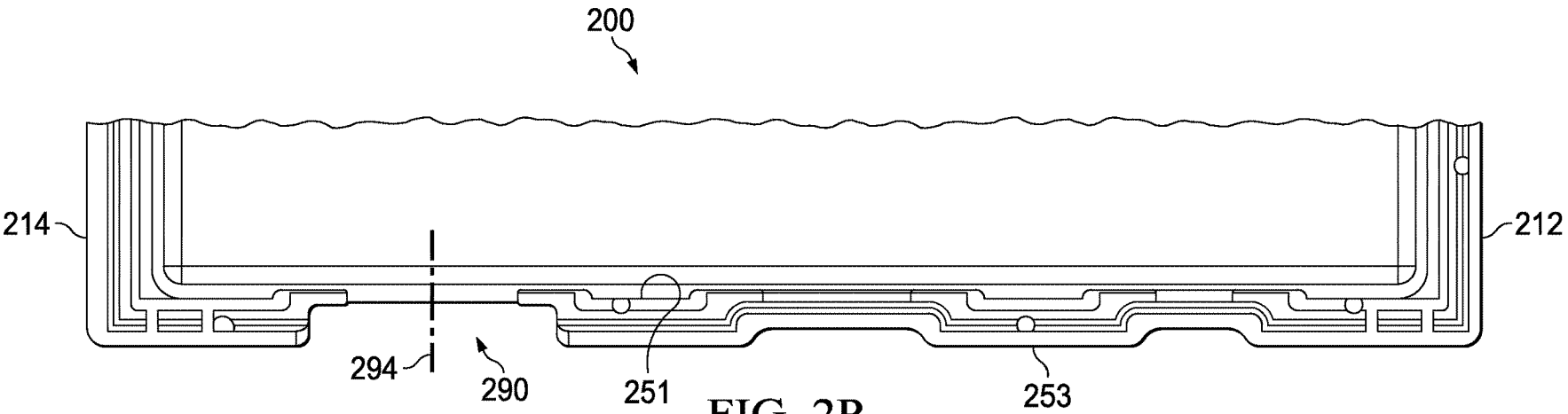
FIG. 2P is a top view of the protective housing structure located at cross-section U-U of FIG. 2O.
Figure 2Q:
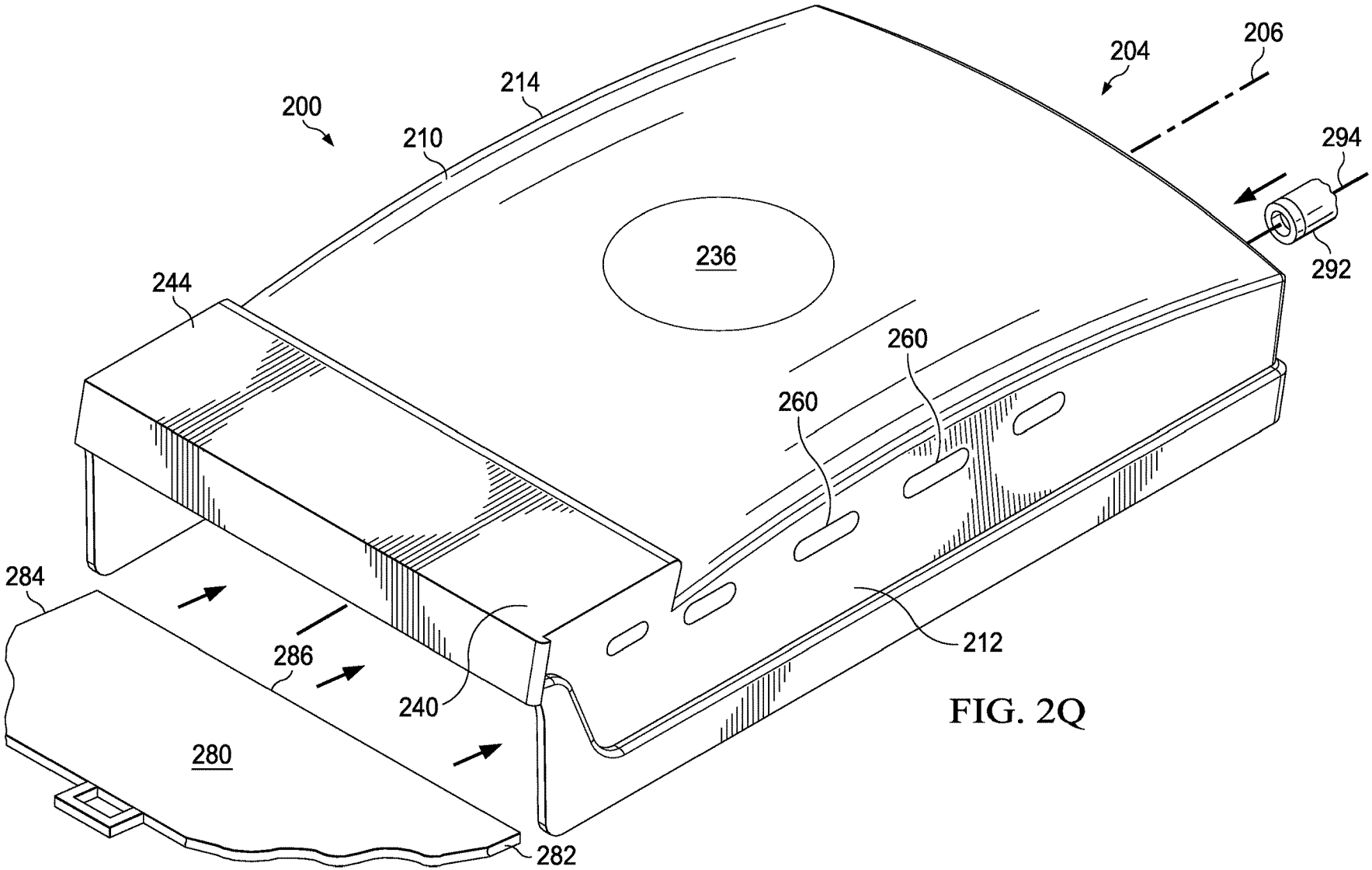
FIG. 2Q is an orthogonal view of an alternative embodiment similar to the protective housing structure of FIG. 2O.
Figure 2R:
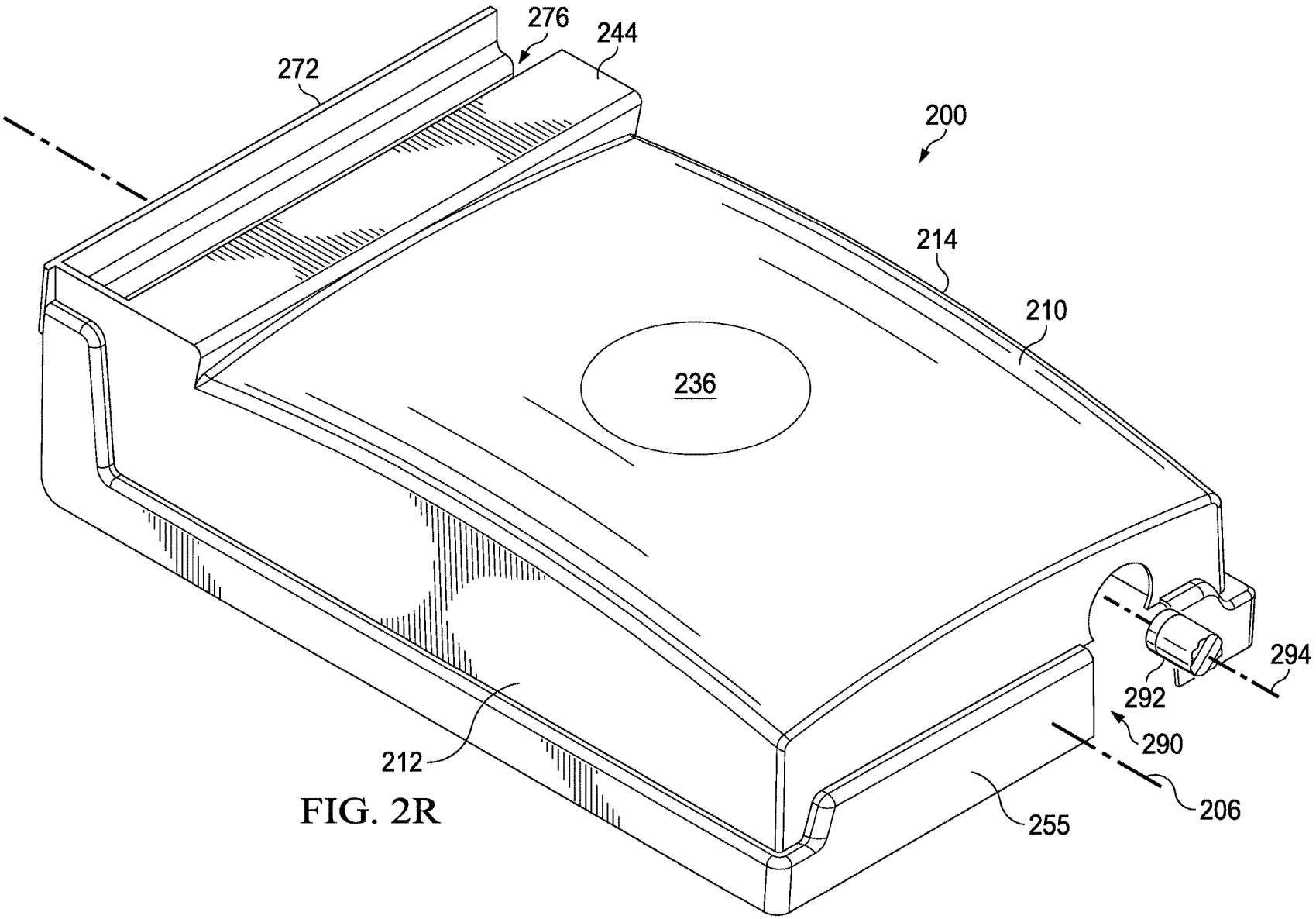
FIG. 2R is an orthogonal view of an alternative embodiment similar to the protective housing structure of FIG. 2O.

Turning now to FIGS. 2A-2R, a variety of orthogonal, side, top, and cross-sectional views of an embodiment of a protective housing structure 200 for a component of an HVAC system, such as 100, are disclosed. In some embodiments, an HVAC system, such as 100, may comprise a protective housing structure 200, that may also be referred to as a shroud. Certain embodiments may alternatively refer to a protective housing structure 200 as a sealable enclosure that includes at least a portion of the enclosure integrally formed and/or attached and/or rigidly attached (non-removable) and/or connected with a wall and/or side of a component of an HVAC system—such as a cabinet of an Air Handling Unit as disclosed in FIGS. 5A-5C. In the disclosed embodiment, protective housing structure 200 comprises a first end 202 and second end 204 with a centerline 206 extending there between. Generally, terms such as distal and proximal are used to refer to spatial/geometrical orientation with respect to the first end 202 and second end 204, with specific use of the term proximal indicating any of facing, and/or being oriented closer to, and/or being relationally closer in proximity to the first end 202, and similarly distal with the second end 204. In some embodiments, a surface, structure, and/or component reference may be disposed and/or located at or near the second end 204 of the protective housing structure 200; however, may still reference a proximal orientation, thus referring to the direction and/or projecting orientation of the surface/structure/component towards the first end 202.

The protective housing structure 200 may also comprise a cover section 208 that is located between the first end 202 and second end 204, where the cover section 208 may include a first side wall 212, second side wall 214, third side wall 250, and dome-shaped top panel 210, where the dome-shaped top panel 210 may be rigidly connected to a side wall 212, 214, 250.

In an embodiment, the first side wall 212 and second side wall 214 may be substantially identical and/or approximately mirrored about centerline 206. Each first 212 and second side wall 214 may comprise a respective proximal end 216, 217, distal end 218, 219, top portion 220, 221, bottom portion 222, 223, inner surface 224, 225, outer surface 226, 227, and lip portion 228, 229. The inner surface 224, 225 of each respective first 212 and second side wall 214 may face and extend along the centerline 206 between the first 202 and second end 204. The illustrated embodiment shown in FIG. 2K discloses the bottom portion 222, 223 of each first 212 and second 214 side wall having a lip portion 228, 229 that extends approximately orthogonal from the outer surface 226, 227 while also extending along the length of each side wall 212, 214 so as to define a gap 228*a*, 229*a* with the outer surface of each side wall 212, 214. In some embodiments, such as FIG. 2G, the third side wall 250 may also include a lip portion 255 and gap 255*a* that is substantially similar and/or the same as that of each gap 228*a*, 229*a* and/or lip portion 228, 229 along the respective side wall 212, 214. In an embodiment, the gap 228*a*, 229*a* may be configured such that each side wall 212, 214 forms a channel with the lip portion 228, 229 and lip portion 228, 229 may include a protruding portion that runs in a parallel and/or about parallel direction to each side wall 212, 214 and in some embodiments may be within a five degree tolerance from parallel. In some embodiments, a lip portion, such as 228, 229, may be configured to be a continuous piece of material and/or configuration that extends around at least some and/or all of the protective housing structure 200.

In the embodiment illustrated in FIGS. 2C, 2F, and 2H, the first 212 and second 214 side walls have a plurality of alternating ribs 260 protruding in a direction substantially orthogonal to the inner surface 224, 225 of each side wall 212, 214 and towards the centerline 206 of the protective housing structure 200. Each of the plurality of alternating ribs 260 extends along the length of the inner surface 224, 225 of each side wall 212, 214—that is, beginning towards the first end 202 with each of the subsequent alternating ribs 260 disposed closer to the second end 204. In the illustrated embodiment, each of the plurality of alternating ribs 260 on the inner surface 225 of the second side wall 214 is so disposed and/or configured as to substantially mirror the disposition and/or configuration of the plurality of alternating ribs 260 on the inner surface 224 of the first side wall 212. As illustrated, the plurality of alternating ribs 260 on each of the side walls 212, 214 comprises individual protruding ribs, with most being approximately similar in height (as shown in at least FIGS. 2C and 2L, the distance as measured in relation to the top portion 220, 221, and bottom portion 222, 223 of each respective side wall 212, 214), width (as shown in at least FIGS. 2C and 2L, the distance as measured in relation from the inner surface 224, 225 of each respective side wall 212, 214 towards the centerline 206), and length (as shown in at least FIGS. 2C and 2L, the distance that may be measured in relation along the centerline 206 from the first end 202 towards the second end 204, and/or in relation along the inner surface 224, 225 of each respective side wall 212, 214).

The alternating ribs 260 are described as alternating due to the configured disposition of each of the individual ribs along each respective side wall 212, 214; that is, in an embodiment, every other rib of the plurality of alternating ribs 260 is disposed at a predefined distance as measured from the bottom portion 222, 223 of each respective side wall 212, 214, and that predefined distance may be the same for every other rib. FIG. 2F is a cross-sectional view taken along line W-W of FIG. 2C. As illustrated in at least one of FIGS. 2C and 2F, the alternating ribs 260 may be configured such that a rib closest to the second end 204 on each of the respective side walls 212, 214 has a vertical stop portion that protrudes transverse to each of the respective walls and transverse to the rib portion extending in the direction along the centerline 206 from the first end 202 to the second end 204. The vertical stop portion of a rib of the plurality of alternating ribs 260 may be configured and/or adapted to stop a control panel 280 (as show in FIG. 2Q) from sliding (and/or being disposed along centerline 206) any further between the plurality of alternating ribs 260 into the opening, such as opening 296 as shown in FIG. 2M, defined by the protective housing structure 200.

More plainly, in an embodiment, a collective plurality of alternating ribs 260 may comprise a top row (relationally closer to the top portions 220, 221) of individual ribs and bottom row (relationally closer to the bottom portions 222, 223) of individual ribs, wherein the top row is disposed at a distance from the bottom portions 222, 223 of each respective side wall 212, 214 that is different than the bottom row's disposition (distance from the bottom portions 222, 223 of each respective side wall 212, 214). As shown in at least FIGS. 2C, 2F, and 2L, the differing distances of the top row and bottom row from the bottom portions 222, 223 may be configured so as to form a gap and/or channel between the top and bottom row as measured between the top portion 220, 221, and bottom portion 222,223 of each respective side wall 212, 214, which can be seen in FIGS. 2C, 2F, and 2L. The disposition of the alternating ribs 260 may in a configuration so as to operatively engage with a control panel plate 280, with alternative embodiments shown in at least FIGS. 3A-3D. Specifically, in an embodiment shown in FIGS. 2C and 2Q, at least two ribs of the plurality of ribs 260 of each side wall 212, 214 are disposed in a configuration that secures a control panel plate along centerline 206 by frictional force. As illustrated in at least FIGS. 2C and 2Q, the first peripheral edge 282 and second peripheral edge 284 of control panel 280 may operatively engage with the alternating ribs 260 such that the control panel 280—when placed between each for the side walls 212, 214 and beneath the dome-shaped top panel 210 such that the distal end 286 of the control panel 280 is oriented towards the second end 204—is between the top row and bottom row of alternating ribs 260 and is held in place by frictional force. The control panel 280 (which may include a control component as disclosed in embodiments of FIGS. 3A-3D) may be at least partially disposed within the protective housing structure 200 (which may be a sealable enclosure) and/or within a cavity/wall space of a component of an HVAC system. In some embodiments, the plurality of alternating ribs 260 may be manufactured from the same material as each of the side walls 212, 214 and/or be molded, cast, formed, or created as one structure with each of the side walls 212, 214.

In the embodiment illustrated in at least FIGS. 2C and 2F, each of the side walls 212, 214 may comprise a stopping rib 262. The stopping rib 262 may be a protrusion from a side wall 212, 214 and configured such that the stopping rib is transverse to the side wall 212, 214. In some embodiments, a stopping rib 262 on a side all 212, 214 may be connected with one of the ribs of the plurality of alternating ribs 260 of a side wall 212, 214. A stopping rib 262 may be configured transverse to at least one alternating rib such that the stopping rib 262 prevents placement and/or operative engagement of a panel, such as control panel 280, along a path of the center 260 that is below the plurality of alternating ribs 260 and above the bottom portion 222, 223 of each respective side wall 212, 214.

The cover section 208 may also comprise the dome-shaped top panel 210 that may be rigidly attached to the first side wall 212 and second side wall 214. In the embodiment illustrated in FIGS. 2A-2R, the dome-shaped top panel 210 has an inner surface 230, an outer surface 232, and an apex 234. Some embodiments may refer to the dome-shaped top panel 210 as a dome-shaped top cover. In an embodiment, the outer surface 232 of the dome-shaped top panel 210 has a planar surface 236 located at or near the apex 234 of the dome-shaped top panel 210. The planar surface 236 of the dome-shaped top cover 210 may be configured to be complementary and/or parallel and/or about parallel with an adjacent surface and/or structure, such as a wall of an HVAC component (e.g., a wall of a double-walled cabinet). In some embodiments, the planar surface 236 may be configured in such a way as to distribute an applied force via the outer surface 232. Further elaboration regarding the protective housing structure's 200 distribution of an applied force is disclosed below. The planar surface 236 at or near the apex 234 may be configured such that injection and/or expansion of insulating material that passes over the dome-shaped top structure 210 will cover and/or encompass a surrounding area proximate to the dome-shaped top structure 210—that is, the configuration and planar surface 236 is such that it does not create and/or allow a void of insulating material to form in an area proximate to the dome-shaped top structure 210. While the dome-shaped top panel 210 may not be in the exact shape of a dome because of at least the planar surface 236, the dome-shaped top panel 210 may be such that the outer surface 232 curves away from the apex 234 towards an edge portion 238 of the dome-shaped top panel 210, and/or the inner surface 230 may have a concave curve 231 with respect to facing the centerline 206. For example, the dome-shaped top panel 210 may include at least a partial hemi-ellipsoidal curvature and/or at least a portion curving away from the apex 234 that resembles a hemi-ellipsoidal curvature. It is understood that, in some embodiments, the dome-shaped top panel 210 may have a variable and/or constant radius of curvature in at least a portion of the structure. In an embodiment, the dome-shaped top panel 210 is configured as to resist material deformation in at least in a direction orthogonal to the planar surface 236 located at or near the apex 234.

As illustrated in an embodiment, the edge portion 238 may comprise the area where the dome-shaped top panel 210 and at least one side wall (such as 212, 214, 250) meet and/or come together. In an embodiment, at least some of the edge portion 238 of the dome-shaped top panel 210 is rigidly coupled to the top portion 220, 221, 252 of any of the side walls 212, 214 and/or 250. The side walls, such as any of a first 212, second 214, and/or third 250 side wall, may be so configured as to vertically support the dome-shaped top panel 210 at a predefined distance from the bottom portion 222, 223, 254 of each of the respective side walls 212, 214, 250. In an embodiment, the plurality of side walls 212, 214, 250 may be configured to be about equal in height at the edge portion 238, particularly the corners where the side walls meet—that is where the dome-shaped top panel 210 transitions to sidewall 212 and 250, along with the dome-shaped top panel 210 transitioning to sidewall 214 and 250. More plainly, the protective housing structure 200 is configured such that the height at the corners where each of the side walls 212, 214, 250 meet the dome-shaped top panel 210 is about uniform. The first 212 and second 214 side walls may be configured in such a way that each of the first side wall 212 and is set apart a predetermined distance from each other, as illustrated in the disclosed embodiment of at least FIG. 2C.

As mentioned, the cover section 208 may include a third side wall 250. A third side wall 250 may comprise a proximal end 251, a distal end 253, a top portion 252, a bottom portion 254, an inner surface 256, and an outer surface 258. In an embodiment, the third side 250 wall is rigidly coupled with each of the edge portion 238 of the dome-shaped top panel 210, the first side wall 212, and the second side wall 214. As disclosed in at least FIGS. 2D and 2G, the third side wall 250 is adjacent to the distal end 218, 219 of each side wall 212, 214 and transverse to centerline 206 and may not be orthogonal relative to the centerline 206 as measured from the bottom portion 254 to top portion 252. The third side wall 250 may be disposed such that that the outer surfaces 226, 227 of each of the first 212 and second 214 side walls and the outer surface 232 of the dome-shaped top panel 210 are sealed from their respective inner surface 224, 225, 230, as shown in FIGS. 2C and 2L. In some embodiments, the third side wall 250 is configured in such a way that the control panel plate 280 is not prohibited from operatively engaging with at least two ribs of the plurality of alternating ribs 260 of each first 212 and second 214 sidewall.

The disclosed embodiments illustrate at least one hole and/or opening 290 in the third sidewall 250; specifically, the third side wall 250 may be configured as to define at least one opening 290 between the proximal end 251 and the distal end 253. The at least one opening 290 defined by the third side wall 250 may be adapted to receive a plug 292 along a central axis 294 of the at least one opening 290, as illustrated in FIGS. 2P, 2Q, and 2R. In some embodiments, a plug 292 may be referred to as a grommet with a seal, where the plug 292 is molded into the protective housing structure 200 during manufacture and/or have a molded groove such that the plug 292 and/or grommet can be placed in the groove. The plug 292 may be disposed in such a way as to at least substantially cover and/or create a barrier around the at least one opening 290, and in some embodiments may form a seal between the proximal end 251 and distal end 253 of the third side wall 250. A purpose of forming a seal may be to keep external environmental materials (e.g., expanding foam) from entering the inner cavity of the protective housing structure 200, thereby protecting components (e.g., electrical control panels) that may be likely to experience problems from various levels of environmental exposure. In some embodiments, a seal and/or plug 292 may be described as airtight and/or watertight; however, it is understood that an in some embodiments, a perfect airtight and/or watertight seal and/or plug 292 is not necessary and a substantial airtight and/or watertight seal and/or plug 292 may be sufficient. The third side wall 250 may also include a lip portion 255 that is configured to define a gap 255*a* as illustrated in FIG. 2G and/or substantially as the previously described lip portions 228, 229 and respective gaps 228*a*, 229*a*. In an embodiment, a plug 292 may be disposed in at least a portion of gap 255*a*, and/or lip portion 255 may be configured such that gap 255*a* at least partially retains plug 292 so as to restrict movement along the central axis 294 of the at least one opening 294. It is understood that plug 292 may be configured such that objects (e.g. wires and/or cabling) may extend through the plug 292 along the plug axis 294 while maintaining a seal between the inner and outer surfaces of the protective housing structure 200. In an embodiment, the lip portion 255 and gap 255*a* may surround the perimeter of a defined at least one opening 290. It is understood that in some embodiments, each of a plurality of openings 290 in the third sidewall 250 may include the same general configuration, but have varying dimensions, such as illustrated in FIGS. 2A and 2O.

A protective housing structure 200 for an HVAC system may also comprise a first sealing section 240 that includes a proximal side 241 that faces the first end 202 of the protective housing structure 200 along centerline 206. The first sealing section 240 may be located adjacent to the cover section 208 and between the first 202 and second 204 ends. In a disclosed embodiment, the first sealing section 240 has a first transverse member 242 extending transverse to the centerline 206. The first sealing section may be rigidly coupled with any of the cover section 208 and disclosed above, and in some embodiments, the first sealing section 240 may be one continuous and/or unitary structure and/or piece of material with the cover section 208, where the protective structure 200 was manufactured out of continuous piece of material.

In an embodiment of the protective housing structure 200, the first transverse member 242 has an upper surface 244 that is an outer surface, where the upper surface 244 is a planar surface that may be disposed and/or configured approximately parallel to and/or complementary with the planar surface 236 of the dome-shaped top panel's 210 outer surface 232. The upper surface 244 may be located approximately at the same elevation (measured as vertical height, such as from centerline 206 to the upper surface 244) as the planar surface 236 of the dome-shaped top panel's 210 outer surface 232. The upper surface 244 may be a predetermined length as measured along the centerline 206 from the first end 202 towards the second end 204. The first transverse member 242 may be configured as to form a vertically extended lip 248 (that is as measured in the direction from the centerline 206, such as bottom portion 222 to top portion 220 of a first side wall 212). In some embodiments, the vertically extended lip 248 may comprise the proximal end 241 and/or the upper surface 244 of the first sealing section 240. In an embodiment, the first transverse member 242 and/or a feature therein (such as the vertically extended lip 248) has lateral flexibility in a direction along the centerline 206 of the protective housing structure 200—that is, the first sealing section 240 may be configured such that an applied force causes material deflection in the direction along centerline 206, while also being configured so as to prevent and/or not allow material deformation from an applied force. In some embodiments, an applied force may be at least about 10 pounds per square inch and less than or equal to about 100 pounds per square inch.

As illustrated in at least FIGS. 2A, 2C, 2E, 2M and 2N, the first transverse member 242 may be disposed as to define an opening 296 and/or cavity of the protective housing structure 200; where the opening 296 and/or cavity is between the first side wall 212 and second side wall 214, and below the first transverse member 242 and dome-shaped top panel 210. The opening 296 extends along the centerline for a predetermined distance from the first end 202 toward the second end 204. The opening 296 may also be adapted to receive a control panel 280, as disclosed below in embodiments shown in FIGS. 3A-3D. The first sealing section 240 and/or first transverse member 242 may be so disposed that the outer surfaces 226, 227, 232 of each of the first side wall 212, second side wall 214, dome-shaped top panel 210, and first transverse member 242 are sealed from their respective inner surface 224, 225, 230, 246. For example, insulation material may be prevented by entering the opening 296 and/or cavity of the protective housing structure 200—that is exposing the inner surfaces of the protective housing structure 200 to the insulation material—because of at least the first sealing section 240 being a continuous structure with the cover section 208. In an embodiment, the first sealing section 240 is proximate (closer to) to the proximal end 216, 217 of each first 212 and second 214 side wall.

As illustrated in at least FIGS. 2A, 2D, 2E, and 2F, the protective housing structure 200 may also include a second sealing section 270 that is connected with and adjacent to the first sealing section 240, the second sealing section 270 being located at or near the first end 202. In an embodiment, the second sealing section 270 has a second transverse member 272 extending transverse to the centerline and rigidly coupled to the proximal end of each of the first and second side walls. As described with other sections of the protective housing structure 200, the second sealing section 270 may be formed as one continuous piece with the first sealing section 240 and cover section 212. In the illustrated embodiment, the second transverse member 272 has an upper surface 274 that may be a planar surface that is approximately parallel to and/or complementary with the planar surface 236 of the dome-shaped top panel's 210 outer surface 232. Both the upper surface 274 and planar surface 236 of the dome-shaped top panel 210 may be configured to be complementary with an object and/or structure (such as insulation material) that applies a force to the outer surface and/or skin of the protective housing structure 200. The illustrated embodiment discloses the upper surface 274 of the second transverse member 272 being located approximately at the same elevation (measured vertically from the centerline 206 as illustrated) as the planar surface 236 of the dome-shaped top panel's 210 outer surface 232. The second transverse member 272 may be configured (and/or disposed between the first 212 and second 214 side walls and adjacent with the cover section 208 and/or first sealing section 240) as to define a channel 276 with a proximal side 251 of the first sealing section 240 and/or the cover section 208. In an embodiment, the channel 276 may be defined by a proximal side 241 of the first sealing section 240 and the second transverse member 242, with both extending between the first 212 and second 214 sidewalls.

In an embodiment, the channel 276 may be configured such that responsive to insulation material (including expanding foam insulation material) coming into contact with the protective housing structure 200, the expanding foam can enter the channel 276 and—due to the nature of expanding foam—may apply a horizontal force (along centerline 206) and vertical force (along bottom portion of channel 276) that causes the second transverse member 272 to deflect along the centerline 206 and/or be biased into contact with an adjacent structure, which may form a seal with an adjacent structure (such as a cabinet wall) so as to prevent insulation material from entering the opening 296 and/or cavity of the protective housing structure 200. Stated another way, the second transverse member 272 of the second sealing section 270 may be configured as to form a vertically extended lip that allows deflection along the centerline 206 of the protective housing structure 200. It is understood that deflection includes a structure (or portion thereof) flexing in a direction from an applied force. It is understood that deflection and/or flexing of a structure may not be required to form a seal and/or keep environmental materials from entering opening 296 and/or coming into contact with inner surfaces of protective housing structure 200. Additionally, it is understood that an applied force may not cause deflection and/or flexing in a structure, yet still allow a seal to be formed, such as because of an applied force on a structure being in biased contact with an adjacent surface and/or structure (e.g. a wall of a component of an HVAC system).

The channel 276 may be open on one end (as illustrated in embodiments shown in at least FIG. 2A, 2B, 2M, 2N, or 2R,) such that the second transverse member 272 may deflect while also, in an embodiment, allowing expanding foam, to exit the channel 276 without entering and/or spilling over into the opening and/or cavity 296. Allowing expanding foam to exit via the open end of channel 276 may help to ensure that irregularities and/or voids are minimized on a side of the protective housing structure 200 that is opposite of where expanding foam may be injected. The channel 276 may alternatively be described as being defined by the second transverse member 272 that connects with a first sealing section 240 and/or a cover section 208 such that one end of the channel 276 is closed, as illustrated in FIG. 2N. In alternative embodiments, both ends of the channel 276 (i.e., each end closest to each side wall 212, 214) may be closed or both ends may be open. Irrespective of whether the channel 276 has closed or open ends, the second transverse member 272 of the second sealing section 270 may be disposed so that the outer surfaces 226, 227 of each of the side walls 212, 214 and the outer surface 232 of the dome-shaped top panel 210 are sealed from their respective inner surface 224, 225, 230. Incorporating the second sealing section 270 with the other sections, such as the cover section 208, during the manufacturing process, such as injection molding using thermoplastic, (as opposed to separate manufacture and then subsequent assembly) allows for a continuous unitary structure that prevents insulating material from contacting an inner surface of at least one of sections of the protective housing structure.

The illustrations disclosed in FIGS. 2E and 2F show the channel 276, second transverse member 272, upper surface 274, and a second transverse member step portion 272*b* and second transverse member gap portion 272*a*. The second transverse member step portion 272*b* and second transverse member 272 may be configured similar and/or the same as the lip portions 228, 229 such that the second transverse member gap portion 272*a* is defined. The gap portion 272*a* (along with previously discussed gaps 228*a*, 229*a*, 255*a*) may be configured to accept and/or mate with a proximate structure. For example, a wall of a cabinet in a HVAC system may have a male structure that aligns and mates with the discussed gap portion 272*a* (among other gaps discussed 228*a*, 229*a*, 255*a*), thereby protecting the inner surfaces of the protective housing structure 200 from objects such as insulating material. The gap 228*a*, 229*a*, 255*a*, 272*a* and lip/step portions 228, 229, 255, 272*b* of the protective housing structure 200 may also be referred to as a "tongue and groove" configuration, where the "groove" corresponds to the disclosed gaps and the "tongue" corresponds with a structure proximate to the protective housing structure, such as a component of an HVAC system (e.g., a wall of an air handling unit's double-walled cabinet). In an embodiment, the channel 276 may be u-shaped, while other embodiments may include the second transverse member step portion 272*b* (shown in cross-sectional view in FIGS. 2E and 2F) that provide a "step" along at least a portion of the second transverse member 272. In the illustrated embodiment, any of the proximal side 241 of the first sealing section 240 and/or the second transverse member 272 and/or the step portion 272*b* may be configured to meet at predefined angle from 90 degrees—that is, not connecting orthogonally. In an embodiment, two sections (and/or portions within on section) meeting at an obtuse or acute angle may allow a particular section of the protective housing structure 200 (and/or portion thereof) to flex and/or deflect from an applied force. In response to an applied force, the relative angle of a surface measured from 90 degrees may become closer to 90 degrees. As an example of how a section can flex and/or deflect, FIG. 2E illustrates channel 276 with second transverse member 272 being disposed at an angle 272*c* from 90 degrees (relative to a direction out of the page from centerline 206 in FIG. 2C), where an applied force (such as that of expanding foam insulation material) causes deflection of the second transverse member 272 in an direction along centerline 206 (that is from back end 204 to front end 202).

In some embodiments of an HVAC system and/or implementing method, the protective housing structure 200 (shroud, sealable enclosure), or a section thereof, may be configured as any of a monocoque structure (sometimes referred to as a monocoque skin structure), a unitary structure, a unitary skin structure, and/or a joint-less structure. A monocoque structure refers to a structural configuration that supports most and/or all applied loads through an object and/or component's outer skin, similar to an egg shell. The protective housing structure 200 may maintain a constant and/or about constant material thickness throughout the structure. In some embodiments, protective housing structure 200 may be considered a monocoque skin structure because material thickness may not exceed 0.115 inches. Similarly, in an embodiment, a protective housing structure 200 may be manufactured by a process such as casting, molding, forming, or photopolymerization (which may include stereolithography). In some embodiments, the entire protective housing structure 200 is injection molded with a material such as 10% glass filled polycarbonate, where the material has a predefined flame rate and is polar in nature such that a polyurethane foam does not adhere. Using an injection molding to form the entire protective housing structure 200 (apart from grommets and/or components that are configured to be removable and thus may operatively engage with sections of the protective housing structure 200) at once may allow for reduced manufacturing costs, as well as assurance that at least the outer surfaces 226, 227, 232, 258 of the protective housing structure 200 are connected together such that the inner surface can be sealed. A monocoque structure may be adapted and/or configured to resist material deformation, such as at least 10 pounds per square inch. As illustrated in FIG. 2A, the protective housing structure 200 may have a planar surface 236 such that the structure 200 distributes an applied load/force via the unitary structure, where the unitary structure prevents the dome-shaped top panel 210 from indenting and/or collapsing. In an embodiment, a unitary skin structure may be a monocoque structure because the structure is configured in such a way as to distribute an applied force via the unitary skin structure. For example, a protective housing structure 200 where at least a majority of the structure is not assembled from individual segments, but rather injection molded (such as with the material polycarbonate) may allow the protective housing structure 200 to act as a monocoque structure because it is unitary in nature. A unitary structure refers to a continuous object and may be such that the structure does not comprise joints (transition areas that are intended be readily articulable over a predefined distance where the material may not flex and/or deflect) and/or seams. In some embodiments, at least a portion of a protective housing structure 200 (shroud) may be integrally formed (i.e., formed with material common to the rest of the structure, and the connection having no mechanical joints) and/or attached and/or rigidly attached (non-removable) and/or connected with any of an exterior wall and/or interior wall that is inside a wall cavity (between an outer and inner wall of a double-walled cabinet).

Figure 5A:
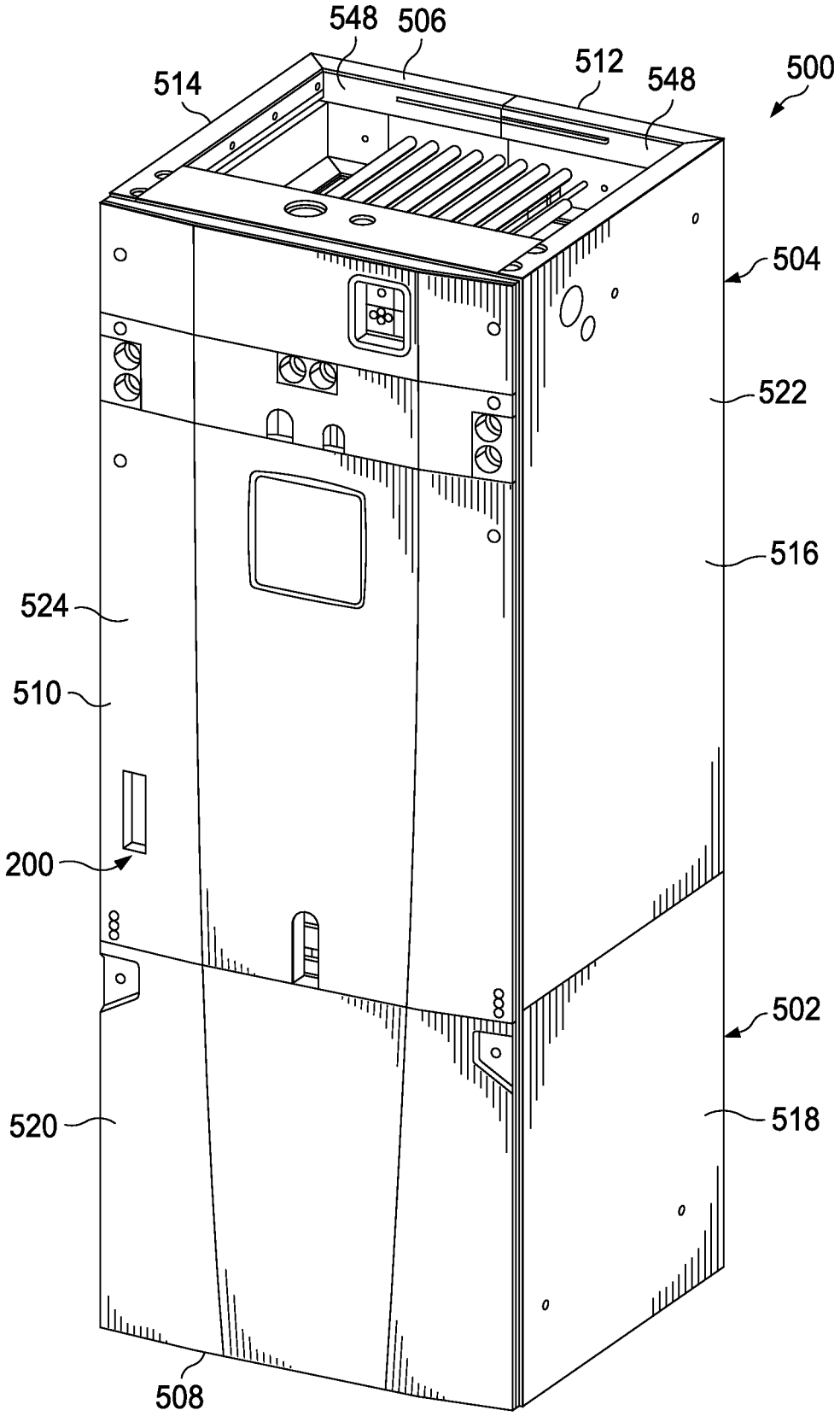
FIG. 5A is an oblique view of an exemplary air handling unit according to embodiments of the disclosure.
Figure 5B:
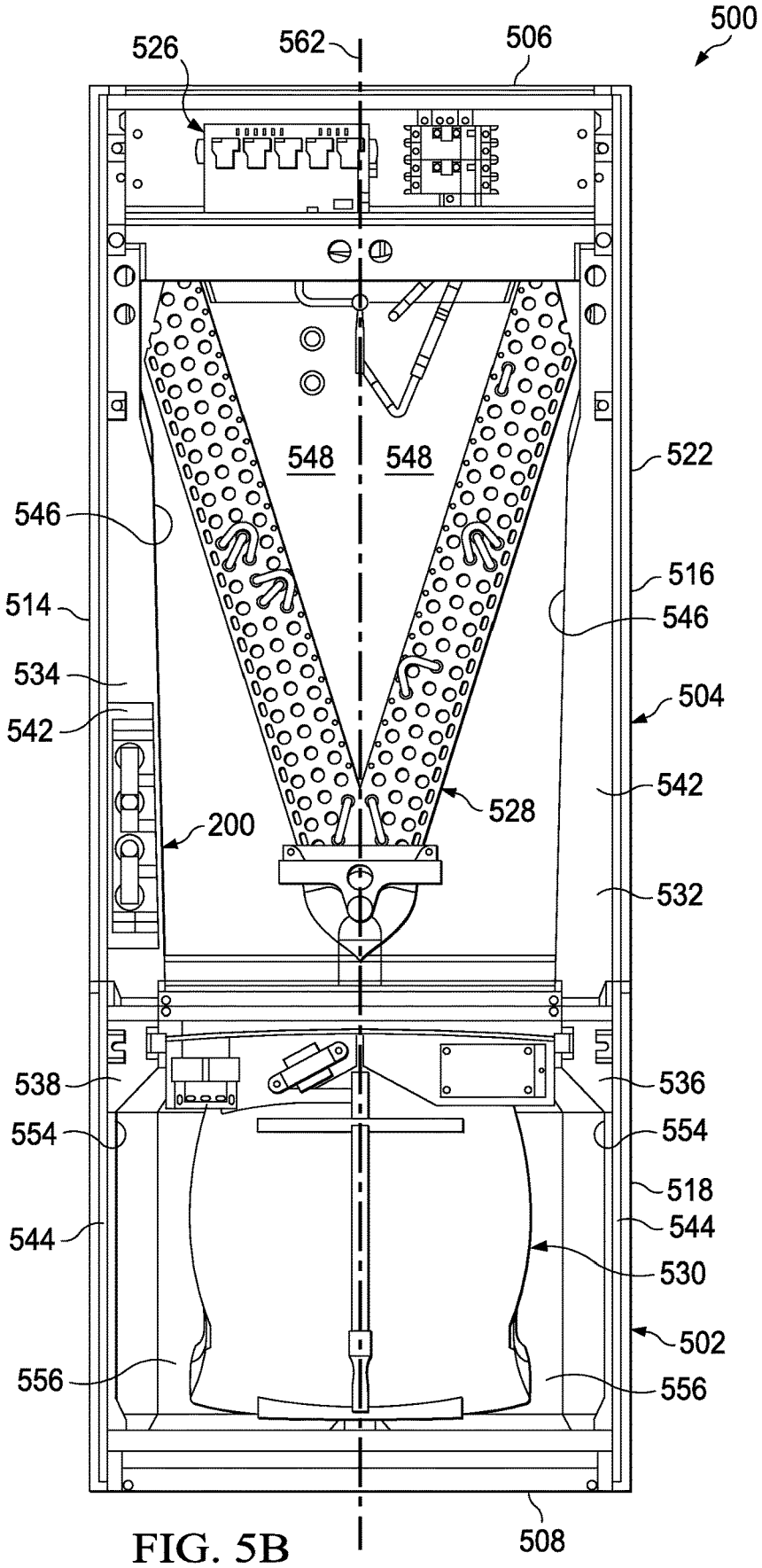
FIG. 5B is an orthogonal view of the air handling unit of FIG. 5A in an assembled configuration.
Figure 5C:
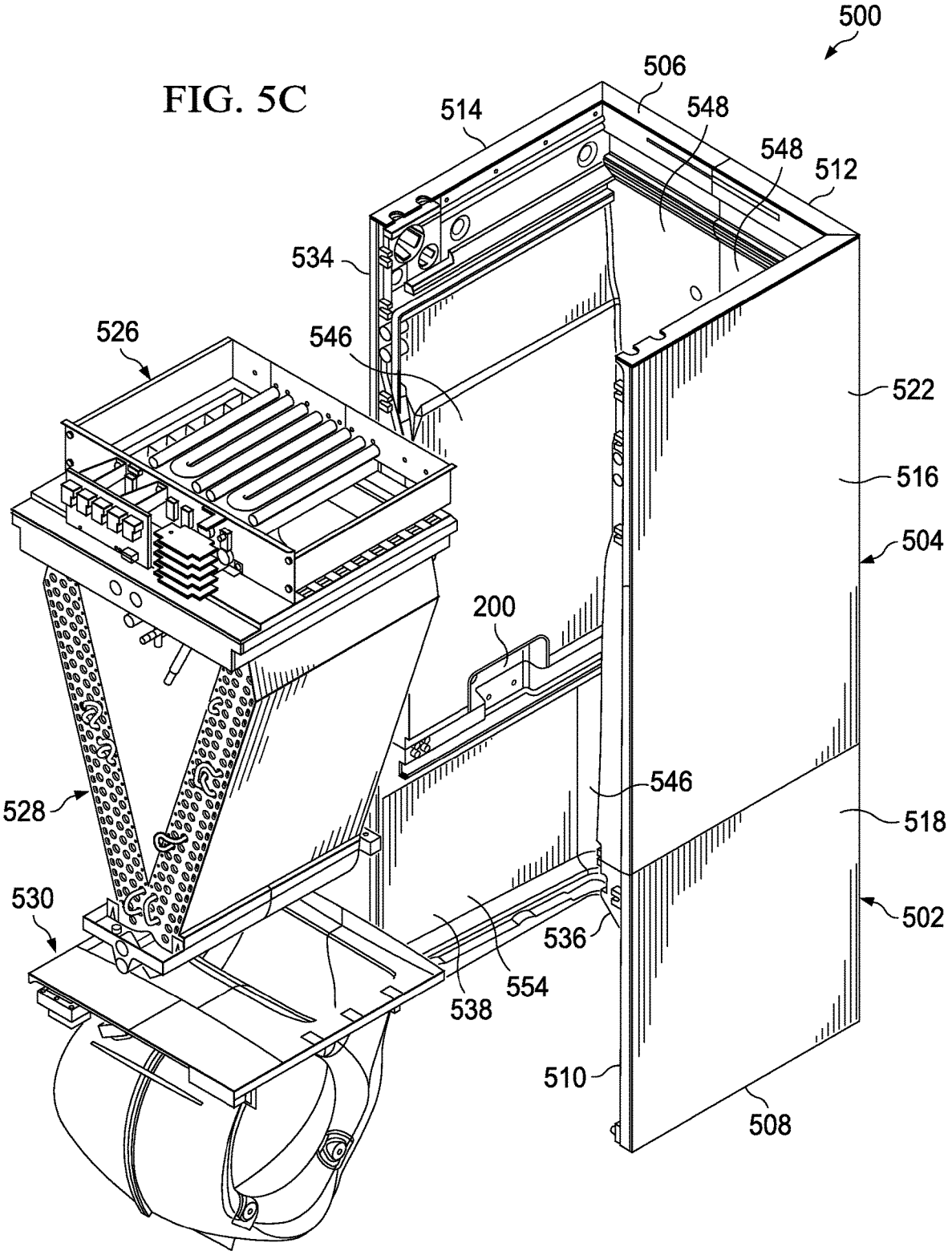
FIG. 5C is a partially exploded oblique view of the air handling unit of FIG. 5A.

The present disclosure also includes a method for protecting components of HVAC system, such as described in FIGS. 5A-5C and/or control panel of FIGS. 3A-3D. The method may use embodiments from systems as disclosed herein. The method may comprise providing a cabinet and/or double-walled cabinet that has an exterior wall and an interior wall, where the at least one exterior wall and the interior wall are disposed in such a way as to form a wall cavity that is at least partially bound by each of the exterior wall and the interior wall. The method may also include rigidly attaching a protective housing structure 200 (also referred to as a shroud) to the double-walled cabinet within the wall cavity. The shroud may be a unitary skin structure and/or a monocoque structure that comprises a plurality of walls connected with a dome-shaped top cover (also referred to as a dome-shaped top pane as described above) that includes a planar surface at or near an apex of the top cover. The protective housing structure (shroud) may be configured to define an opening between the plurality of walls and beneath the dome-shaped top cover where the opening may be adapted to receive a control component only between a plurality of alternating ribs. The protective housing structure may also be configured to form a seal between a peripheral edge of the shroud and at least the inner wall of the double-walled cabinet responsive to an applied force on an outer surface of the shroud (such as expanding polyurethane foam at least partially coming into contact with the shroud). As disclosed previously, the protective housing structure 200 (shroud) may be a monocoque structure that is configured such that the force from an applied load is transferred through the outer structural skin and may be directed towards a peripheral edge of the protective housing structure 200 (shroud) that, in turn, exerts a normal force on a proximate structure (such as a wall) thereby forming a seal between the peripheral edge and a proximate surface (e.g., at least an inner wall of the double-walled cabinet).

The method may also comprise inserting and/or injecting insulation material into a cavity defined by two walls (such as an exterior and interior wall). In the disclosed embodiment, the injection of expanding insulation material may be able to fill substantially all and/or all of the cavity without having voids in material because the protective housing structure 200 (shroud/sealable enclosure) is configured such that a planar surface 236 at or near the apex 234 of the dome-shaped top panel 210 allows expanding foam to spread around and/or behind the structure 200, thus preventing voids of insulating material from forming. The method may also include receiving a control panel in the defined opening of the protective housing structure and between the plurality of alternating ribs.

In some embodiments of the disclosed method, a unitary skin and/or monocoque structure is configured such that a formed seal from an applied force may ensure that the inner surfaces of a protective housing structure 200 (shroud) is not exposed to components and/or elements proximate to a respective outer surface (e.g., insulation material, fluids like water and/or air), thereby protecting a control component and/or control panel (as disclosed in FIG. 3), where the control component and/or panel is disposed within an opening of the protective housing structure 200 that is adapted to receive and/or operatively engage with the control component and/or panel.

Figure 3A:
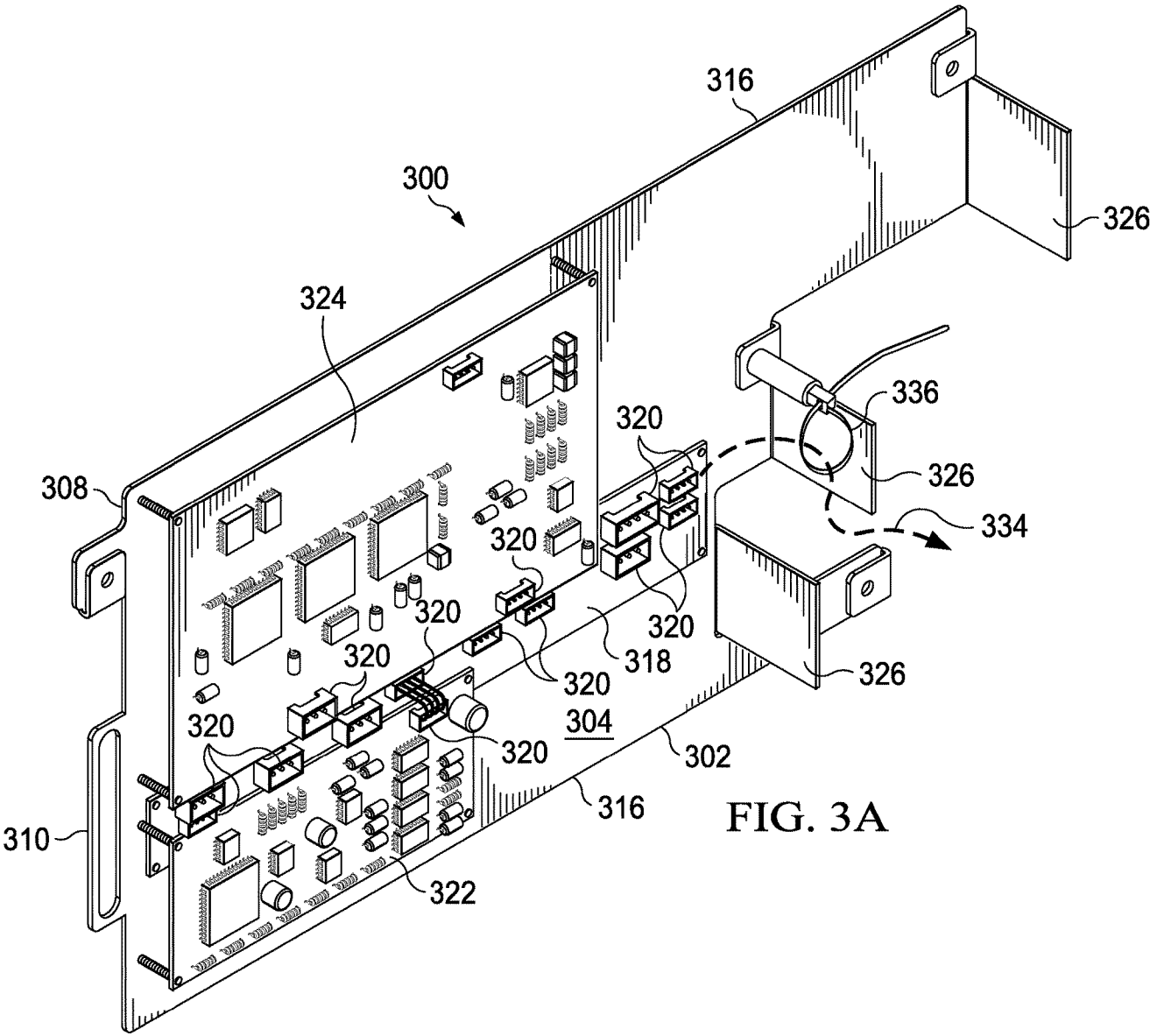
FIG. 3A is an oblique side view of another embodiment of a control assembly.
Figure 3B:
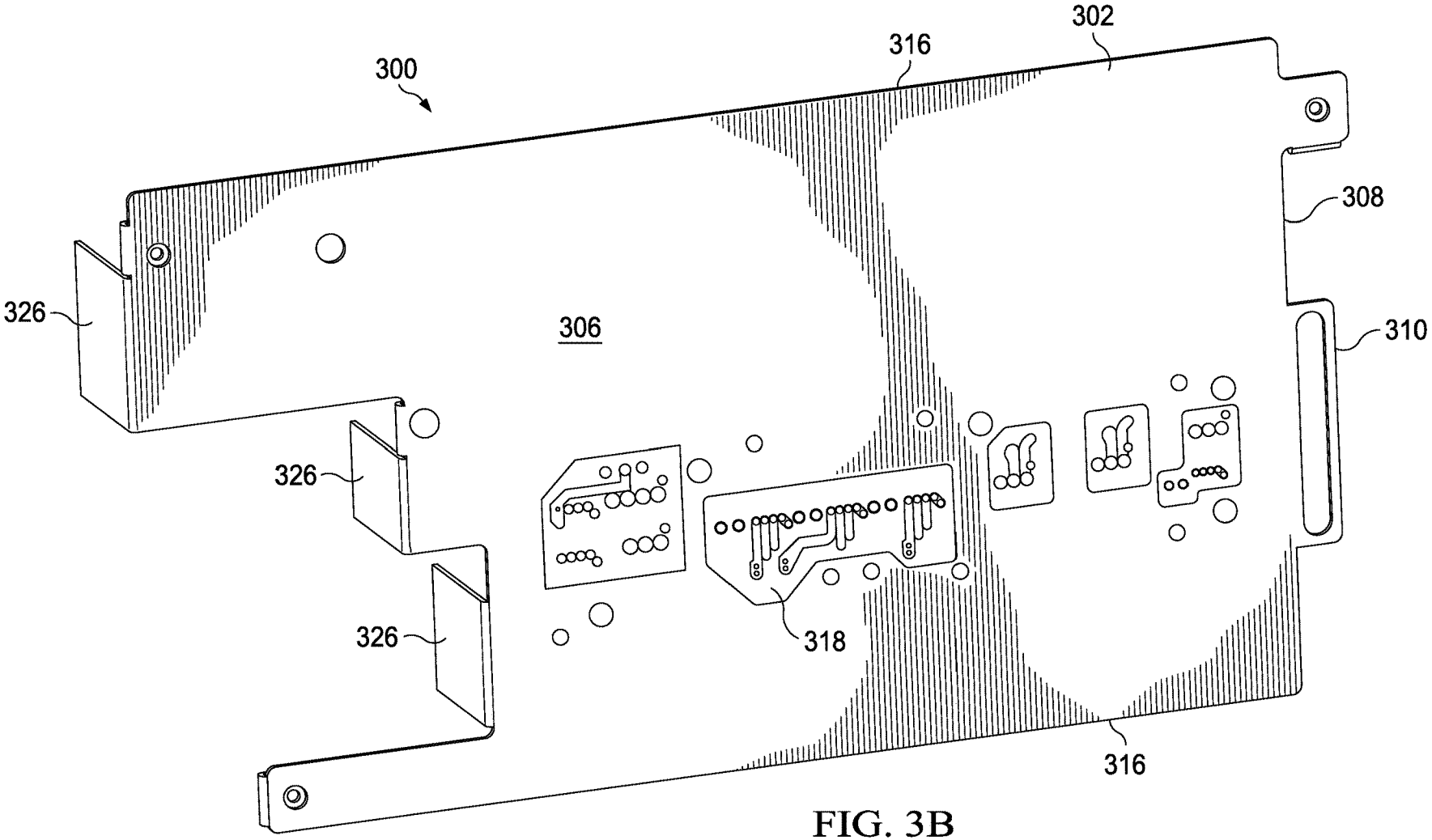
FIG. 3B is an alternate oblique side view of the control assembly of FIG. 3A.

Turning now to FIGS. 3A-3B, an oblique side view of a control assembly 300 (also referred to as a control panel) is disclosed. In some embodiments, control assembly 300 may include a plurality of planar plates and/or panels, as discussed in FIG. 3C and FIG. 3D. It is understood that embodiments of control assembly 300 may operatively, removably, and/or slideably engage with a protective housing structure (e.g., structure 200 of FIGS. 2A-2R, specifically between a plurality of alternating ribs 260) and features disclosed therein. In an embodiment, control assembly 300 may include a control board carrier 302 (occasionally referred to as carrier 302) that may be substantially planar in structure and may be constructed from a variety of materials, such as a metallic material. In some embodiments, the control board carrier 302 has peripheral edges 316 that may be of a predetermined thickness and configured such that the thickness of the peripheral edges 316 are less than a vertical gap that is between alternating ribs of a protective housing structure, thus allowing insertion of the control assembly 300 within a protective housing structure or shroud, such as disclosed in FIGS. 2A-2R. Alternatively, some embodiments may have the predetermined thickness of control board carrier 302 be greater and/or than the vertical gap that is between a plurality of alternating rights of a protective housing structure. Having a thicker control board carrier 302 than the vertical gap of the alternating ribs may provide a retaining force from frictional contact (e.g., an interference fit) between the control board carrier 302 and a side of the alternating ribs, that may cause some of the alternating ribs to deflect and the resulting friction can maintain the control board 302 in position within a cavity and/or inner space of a protective housing structure 200. It is understood that the disclosed embodiments of the present application may be implemented within a system and/or method disclosed.

Some embodiments of control board carrier 302 include a mounting side 304, back side 306, and front end 308 that may comprise a handle 310. It is understood that features such as mounting side 304 are descriptively named so as to exemplify one type of layout for control board carrier 302—that is, electronic components may typically be mounted on a particular side; however, alternative arrangements of mountings may also be included herein, such as on backside 306. Additionally, control board carrier 302 may include and/or be configured to carry a plurality of control boards and/or electrical components. More specifically, the carrier 302 may comprise an interface board 318 that is configured to communicatively couple a plurality of electrical components (e.g., other control boards) on carrier 302, such a via connectors 320. In this embodiment, the interface board 318 is mounted to the carrier 302 via a plurality of electrically conductive fasteners (e.g., eyelets and/or rivets) that electrically connects a ground plane of the interface board 318 to carrier 302 which may have an electrical grounding portion. In some embodiments, control assembly 300 may comprise an electronic expansion valve (EEV) control board 322, and/or an air handler (AH) control board 324, with both capable of being mounted as previously disclosed. It is understood that use of such electrically conductive fasteners may provide electrical grounding with a shared metallic ground on carrier 302. Sharing a metallic ground on carrier 302 may provide a reference for shunting of high-frequency signals for reducing electromagnetic interference. It will be appreciated that although the carrier 302 and the components carried by the carrier 302 may be substantially housed within a protective housing structure (e.g., disclosed in FIGS. 2A-2R), the housing structure may be nonconductive and thus carrier 302 may be further electrically connected to a remote ground associated with components of an HVAC system, which may provide improved consistency for electrical references and may result in improved performance of communication transmission.

Continuing with the disclosed embodiment 300, the carrier 302 may include at least one tab 326 that extends substantially orthogonal from the carrier 302. In some embodiments, the tab 326 may be configured to serve as a stop that interferes with a portion of a protective enclosure (e.g., a third wall transverse to side walls of a protective housing structure as disclosed) when the carrier 302 is being inserted into the protective enclosure. As shown in FIG. 3A, a plurality of tabs 326 may partially bound a wire/harness housing a bundle and/or aggregation of lengthwise (i.e., from handle 310 towards a tab 326) cables and/or electrical conductors when the carrier 302 is fully inserted into an enclosure (such as previously disclosed). In some embodiments, at least one rear tab 326 may be substantially adjacent and/or abut against a portion of an enclosure, such as a wall that is transverse to the direction of peripheral edges 316. For exemplary purposes, cables and/or electrical conductors may pass along a cable route 334 that is represented in FIG. 3A as an arrow meandering between the plurality of tabs 326 and through a wire tie 336. In some embodiments, various physical configurations of the carrier 302 may allow multiple lengths of cables and/or electrical conductors to remain connected to at least one of the interface board 318, the EEV board 322, and the AH board 324 while the carrier 302 is fully removed from, partially inserted into, and/or fully inserted into a protective housing structure, and/or disposed between alternating ribs of a housing structure or enclosure, as previously described above. Furthermore, various electrical boards and/or components of control assembly 300 may be disposed at various elevations, including overlapping, so as to reduce the overall the dimensions of the carrier 302; for example, the EEV board 322 and the AH board 324 may be overlapped with the interface board 318 so as to reduce the distance of the front end 308 (i.e., the distance between periphery edges 316).

Figure 3C:
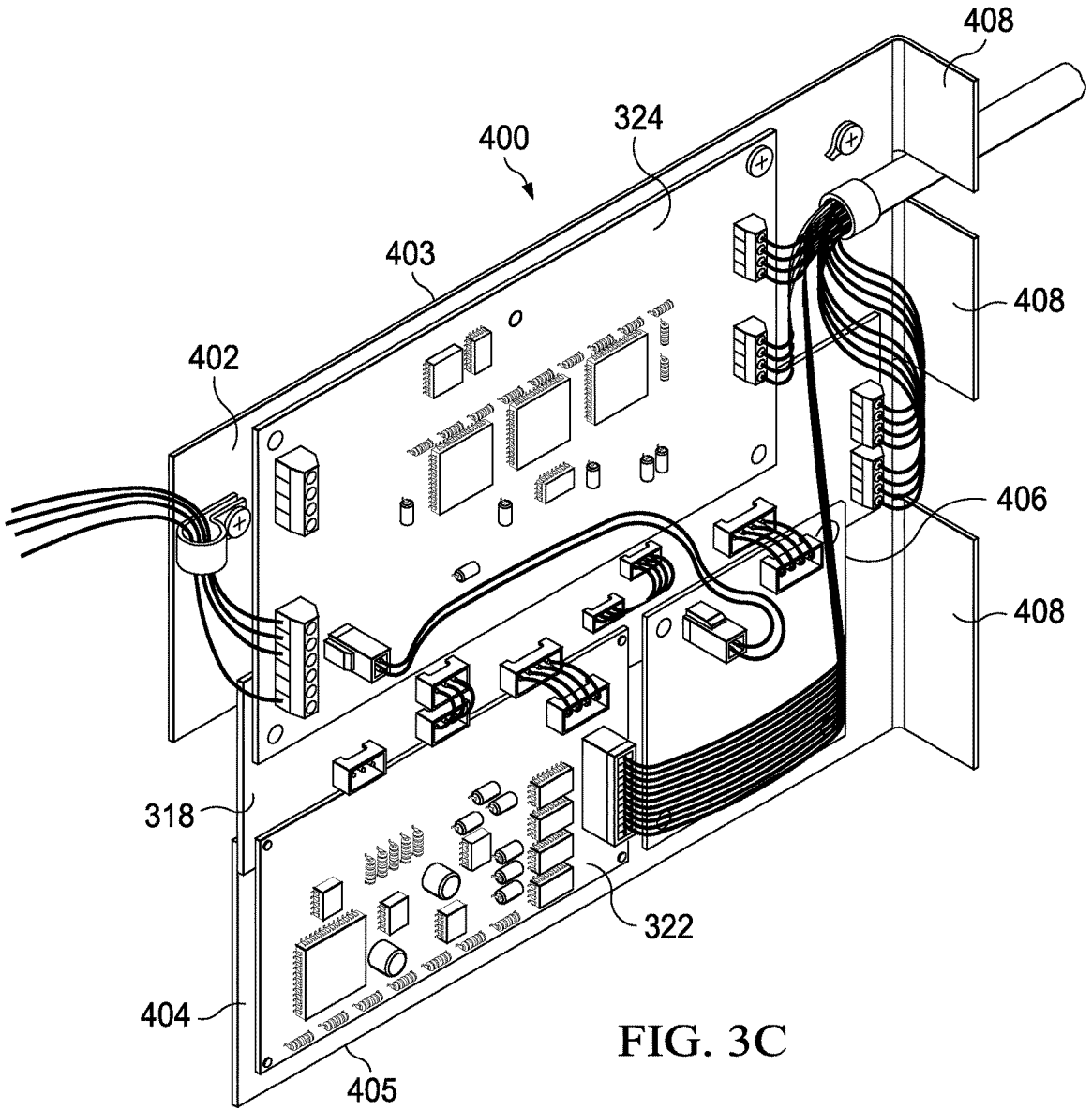
FIG. 3C is an oblique side view of an embodiment of a control assembly.

Referring now to FIG. 3C, an oblique side view of an embodiment of a control assembly 400 is disclosed. In an embodiment, control assembly 400 may comprise components and/or structure substantially similar to control assembly 300; however, the control board carrier 302 of FIG. 3A may be replaced with a plurality of connected carrier boards, such as a first carrier board 402 and second carrier board 404. The first and second carrier board 402 and 404 may each have a peripheral edge (403, and 405 respectively) in which each of the peripheral edges 403, 405 may operatively engage with alternating ribs of a protective housing structure, such as disclosed in FIGS. 2A-2R. The control assembly 400 may be enclosed and protected from external contaminants (such as insulation, air, water) when disposed between each of the side walls and protective cover of the protective housing structure. In some embodiments, a control assembly (such as control assembly 400) may be secured within a protective housing structure by frictional force and/or by removable attachment, such as screws or fasteners. In most embodiments, a control assembly (e.g., 400) is configured to operatively, and/or removably engage with a shroud, or other cover of an HVAC system or cabinet (single or double wall).

In this embodiment, the first and second carrier boards 402, 404 may be rigidly attached together directly and/or by intermediary boards, which may be included with the control assembly 400. For example, first carrier board 402 may be structurally and/or electrically attached to second carrier board 404 via any of interface board 318, EEV board 322, AH board 324, and/or field accessory board 406. Alternative controllers and/or modules may be included on a control panel, such as any of the controllers disclosed in the HVAC system of FIG. 1. In some embodiments, at least one orthogonal tab 408 may extend from a carrier board, such as 402 and/or 404. An orthogonal tab 408 may prevent a control assembly panel from being inserted too far within a protective housing and/or shroud. It is understood that control assembly 400, and any of the components disclosed therein, may be communicatively coupled with each other and/or other systems or components of an HVAC system, such as components disclosed in FIG. 1. In some embodiments, the control assembly 400 may include a cable retainer clip and/or tube to manage excess cables and/or electrical conductors. As disclosed, electrical wiring may be retained between a plurality of orthogonal tabs 408, and such wiring may pass through a protective housing structure, such as passing through openings that are defined by structure disclosed in FIGS. 2A-2R.

Figure 3D:
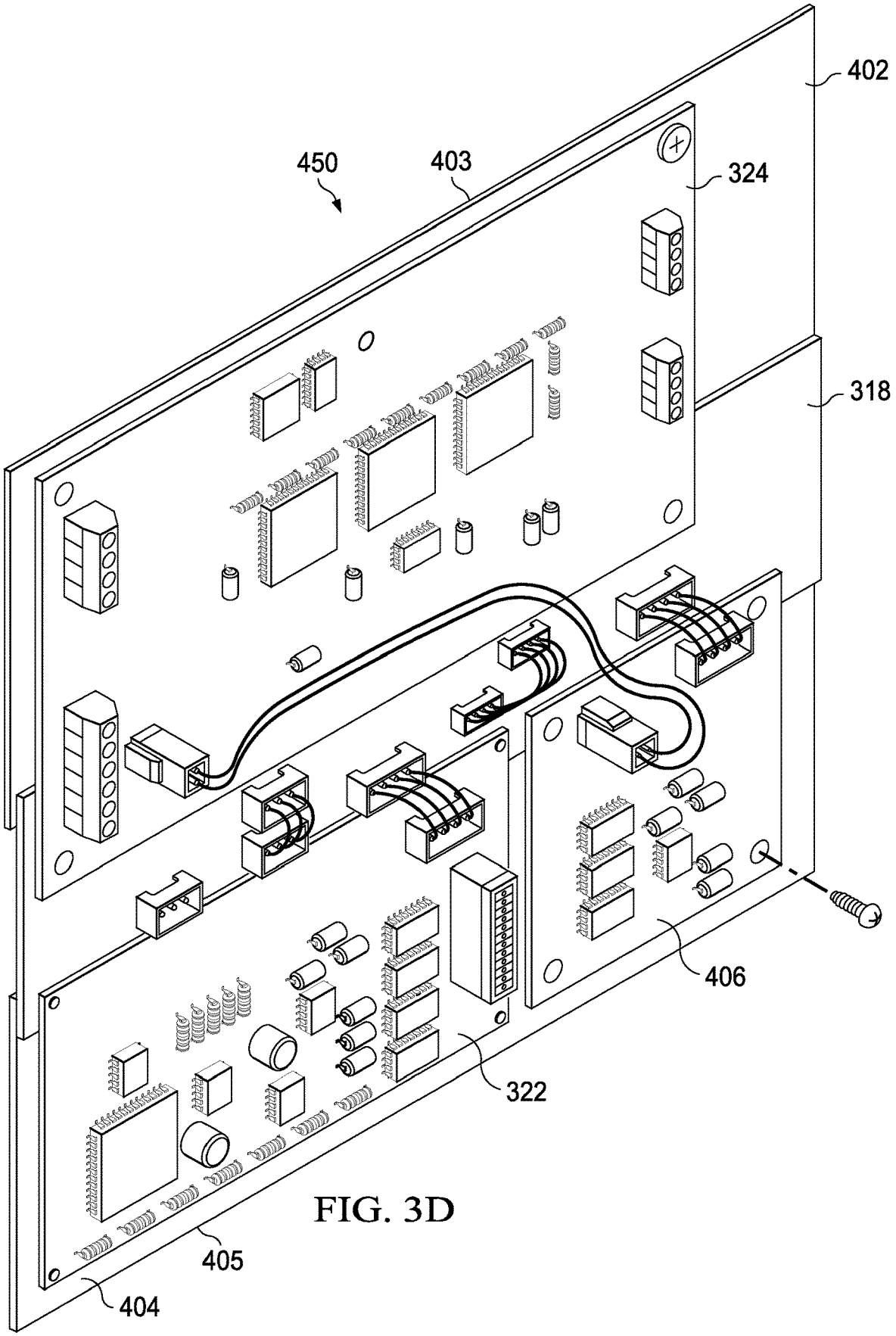
FIG. 3D is an oblique side view of yet another embodiment of a control assembly.

Turning now to FIG. 3D, an oblique side view of yet another embodiment of a control assembly is disclosed similar to FIG. 3C. Control assembly 450 discloses an alternative embodiment similar to control assembly 400 without the plurality of orthogonal tabs 408.

Figure 4A:
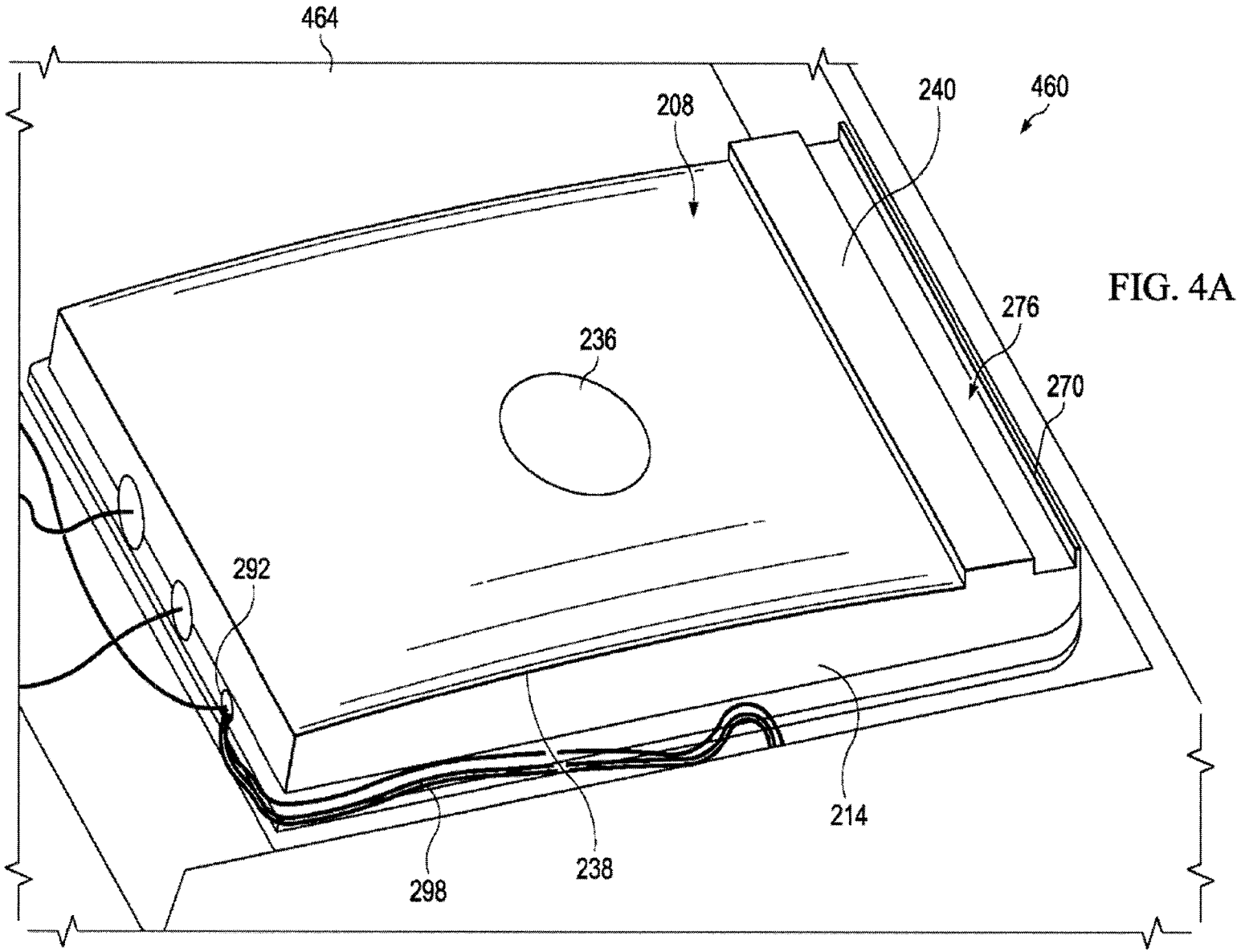
FIG. 4A is an oblique view of an exemplary protective housing cover similar to FIG. 2A.
Figure 4B:
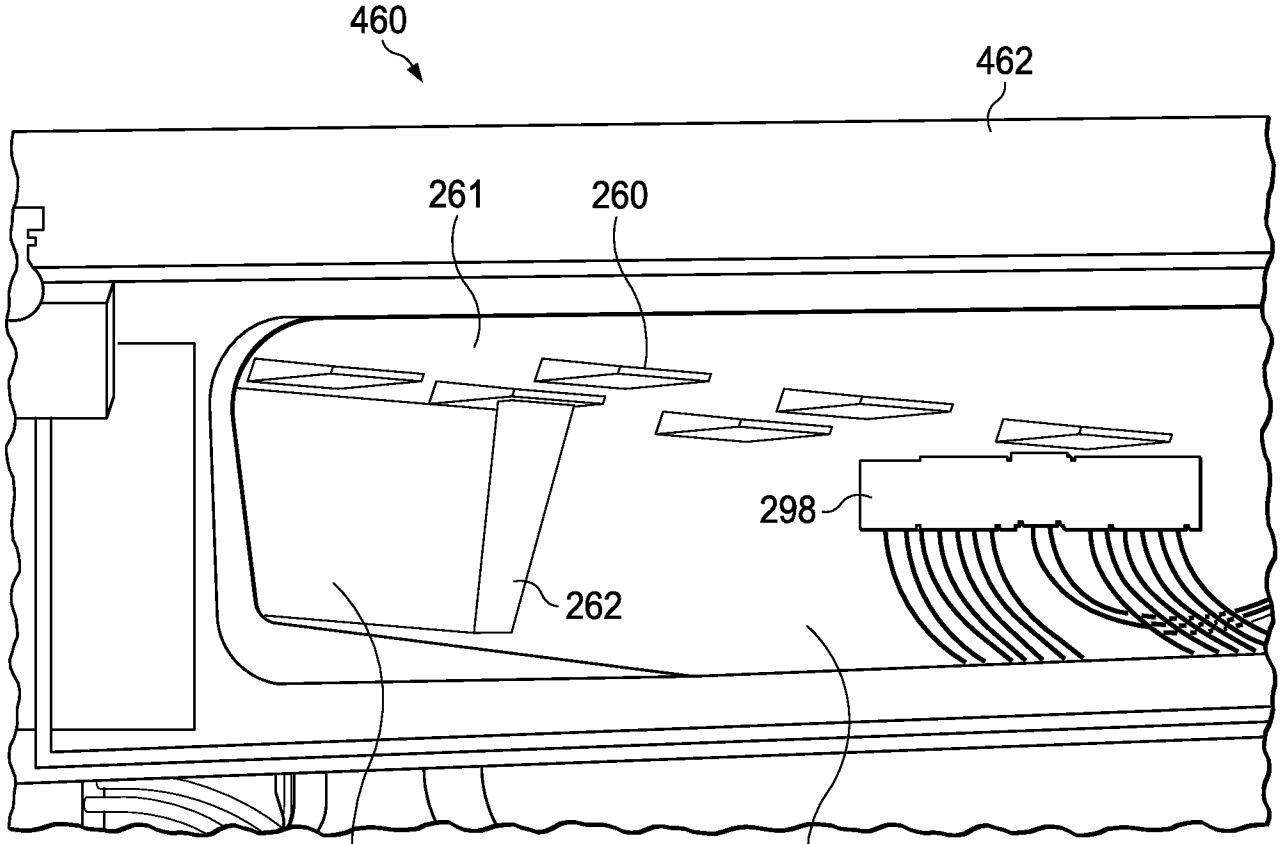
FIG. 4B is an alternate oblique view of the protective cover of FIG. 4A.

Referring now to FIGS. 4A and 4B, two oblique views of an exemplary protective housing structure 460 (shroud/sealable enclosure) as disclosed in FIGS. 2A-2R are illustrated. It is understood that the embodied sections and structures disclosed in FIGS. 2A-2R may apply to the illustrated embodiment of FIGS. 4A and 4B. For clarity, elements common to the embodiments disclosed in FIGS. 2A-2R are labeled the same. For example, FIG. 4A discloses a protective housing structure 460 that has a planar surface 236 located at or near an apex of a dome-shaped panel of a cover section 208. A first sealing section 240 is illustrated that may be at an elevation (i.e., distance from a proximate wall such as interior wall 464) that is about equal to that of the planar surface 236. As illustrated, the cover section 208 includes an edge portion 238 of a dome-shaped top panel, which is where a transition occurs to the second side wall 214. The illustrated embodiment also discloses a plurality of plugs 292 that is configured to allow at least one wire and/or cable 298 to pass through the plug 292 such that a seal is maintained, thereby preventing interior surfaces of the protective housing structure from being exposed to objects in a wall cavity that are proximate to the outer surfaces (e.g., insulation material, fluids, water, and/or air being sealed out and thus separating the two spaces). In the illustrated embodiment, the channel 276 of a second sealing section 270 is closed on one end, and open on the end closest to second side wall 214.

Further, the protective housing structure 460 includes the second sealing section 270 being configure adjacent to a complementary portion of the interior wall 464. As previously described above in FIGS. 2A-2R, insulation material, such as expanding foam, may at least partially encapsulate and/or surround the protective housing structure 460 and flow into channel 276. Expanding foam may exert an applied force to sealing section 270 such that the sealing section 270 flexes and/or materially deflects so as to prevent insulation material from spilling into the opening 296 (and overall interior space/pocket, such as inner surface 225 of second side wall 214) defined by the protective housing structure 460, as shown in FIG. 4B. A seal formed by a deflecting portion of the protective housing structure 460 (such as second sealing section 270) may also prevent insulating material from coming into contact with an adjacent side 462 of inner wall 464.

FIG. 4B discloses an alternate view showing the opening 296 and interior portions of the protective housing structure 460. Wires and/or cable 298 that may pass through one of the plugs 292 are shown as being disposed in a position where wire and/or cable 298 connector may plug into a portion of a control panel (as described above in FIGS. 3A-3D), where the control panel is configured to be disposed and/or operatively engage between the plurality of alternating ribs 260 as illustrated in FIG. 4B. As previously described in FIGS. 2A-2R above, a protective housing structure 460 (and/or embodiments of 200) may include a stopping rib 262 that is a protrusion transverse from a side wall (such as second side wall 214 shown), where the protruding stopping rib 262 extends towards a centerline of the protective housing structure, such as centerline 206 disclosed in the previous embodiments of FIGS. 2A-2R. The stopping rib 262 may be configured to prevent placement of a control panel into the opening 296 (i.e., further into the pocket of the protective housing structure 460) without alignment between the plurality of alternating ribs 260. As illustrated in FIG. 4B, the plurality of alternating ribs 260 may include at least one guide rib 261 that is configured so as to guide a control panel between the plurality of alternating ribs 260.

Turning now to FIGS. 5A-5C, an air handling unit (AHU) 500 is disclosed according to an embodiment of the present disclosure. In an embodiment, an HVAC system, such as the HVAC system 500 previously disclosed, may include an AHU 500 that utilizes a double-walled cabinet. For clarity, this embodiment will refer to an AHU 500 to exemplify a double-walled cabinet, but such embodiments of a double-walled cabinet are not intended to be limiting AHU 500 to a double-walled cabinet, nor limit a double-walled cabinet with an AHU 500. Additionally, references to protective housing structure 200 illustrate exemplary configurations of possible placement of a protective housing structure 200, shroud, and/or sealable enclosure within walls, shells, and/or surfaces of AHU 500. It is understood that alternative placement and/or location of protective housing structure 200 may be possible within a variety of components (e.g. various components within an HVAC system), and the following embodiment denotes an exemplary location in a cabinet of AHU 500.

In this embodiment, AHU 500 may comprise a lower blower cabinet 502 attached to an upper heat exchanger cabinet 504. AHU 500 may be described as comprising a plurality of outer walls (e.g., top side 506, a bottom side 508, a front side 510, a back side 512, a left side 514, and a right side 516). It will be appreciated that such directional descriptions are meant to assist the reader in understanding the physical orientation of the various component parts of the AHU 500; however, such directional descriptions shall not be interpreted as limitations to the possible installation orientations of an AHU 500. Further, it will be appreciated that the above-listed directional descriptions may be shown and/or labeled in the figures by attachment to various component parts of the AHU 500. Additionally, attachment of directional descriptions at different locations or two different components of AHU 500 shall not be interpreted as indicating absolute locations of directional limits of the AHU 500, but rather, that a plurality of shown and/or labeled directional descriptions in a single Figure shall provide general directional orientation to the reader so that directionality may be easily followed amongst various the Figures. Still further, it will be appreciated that the component parts and/or assemblies of the AHU 500 may be described below as comprising top, bottom, front, back, left, and right sides. In some embodiments, directional orientation may be understood as being consistent in orientation with the top side 506, bottom side 508, front side 510, back side 512, left side 514, and right side 516 of the AHU 500.

Continuing with the present embodiment, the blower cabinet 502 may comprise a four-walled fluid duct that accepts fluid (e.g., gaseous air) in through an open bottom side of the blower cabinet 502, and allows exit of the fluid through an open top side of the blower cabinet 502. In the present embodiment, an exterior wall may be any of an exterior of the blower cabinet 502, an exterior of the heat exchanger cabinet 504, a blower cabinet panel 520, heat exchanger cabinet outer skin 522, a heat exchanger cabinet panel 524, heat exchanger cabinet right shell 532, heat exchanger cabinet left shell 534, blower cabinet right shell 536, or blower cabinet left shell 538. It will be appreciated that panels and/or exterior walls of AHU 500 and/or a double-walled cabinet may be removable (e.g., the blower cabinet panel 520) thereby allowing access to an interior space (e.g., the interior of blower cabinet 502 and/or heat exchanger cabinet 504). Examples of such removable panels may include a blower cabinet outer skin 518 and/or a blower cabinet panel 520. Similarly, heat exchanger cabinet 504 may comprise a four-walled fluid duct that accepts fluid (e.g., air) from the blower cabinet 502 and passes the fluid from an open bottom side of the heat exchanger cabinet 504, and allows exit of the fluid through an open top side of the heat exchanger cabinet 504. In this embodiment, the exterior of the heat exchanger cabinet 504 may comprise a heat exchanger cabinet outer skin 522 and a heat exchanger cabinet panel 524, wherein the heat exchanger cabinet panel 524 may be removable. Outer skin, such as 522, may be associated with an interior shell to form a wall space that is at least partially bound by each of the interior shell and the exterior skin.

In this embodiment the AHU 500 may further comprise a plurality of selectively removable components from the interior of the AHU 500. More specifically, components that may be removably carried within the heat exchanger cabinet 504 and/or blower cabinet 502, which may respectively include a heater assembly 526, a refrigeration coil assembly 528, and/or a blower assembly 530. When the AHU 500 is fully assembled (i.e., when at least any of the components 526, 528, or 530 are carried in blower cabinet 502 and/or heat exchanger cabinet 504), it will be appreciated that fluid (air) may follow a path through the AHU 500 along which the fluid enters through the bottom side 508 of the AHU 500, successively encounters the blower assembly 530, the refrigeration coil assembly 528, and/or the heater assembly 526, and thereafter exits the AHU 500 through the top side 506 of the AHU 500.

In this embodiment, each of the four walls of the blower cabinet 502 and the heat exchanger cabinet 504 may be configured to have a double-wall cabinet construction. One embodiment of a cabinet construction and/or double-walled cabinet construction includes at least one exterior wall (e.g., a skin or shell surface) and an interior wall (e.g., a skin or shell surface) being configured to form a cavity, wall space, open, or the like. A wall cavity and/or wall space may be at least partially bound by a plurality of walls (e.g., an exterior and/or interior wall).

More specifically in this embodiment, the heat exchanger cabinet 504 may further comprise a heat exchanger cabinet right shell 532 and a heat exchanger cabinet left shell 534. Here, the heat exchanger cabinet right shell 532 and the heat exchanger cabinet left shell 534 may be joined to form the interior of the heat exchanger cabinet 504. In an embodiment, to form the above-mentioned double-wall cabinet construction for the heat exchanger cabinet 504, the heat exchanger cabinet outer skin 522 may cover a plurality of sides (e.g., the right side and back side) of the heat exchanger cabinet right shell 532, while also covering the left side and back side of the heat exchanger cabinet left shell 534. In an embodiment, the heat exchanger cabinet right shell 532, the heat exchanger cabinet left shell 534, and the heat exchanger cabinet outer skin 522 may be shaped in such a way that upon their assembly together, a heat exchanger cabinet wall space 542 exists between the heat exchanger cabinet outer skin 522 and each of the heat exchanger cabinet right shell 532 and the heat exchanger cabinet left shell 534. Similarly, the blower cabinet right shell 536, the blower cabinet left shell 538, and the blower cabinet outer skin 518 may also be shaped in such a way that upon their assembly together a blower cabinet wall space 544 exists between the blower cabinet outer skin 518 and each of the blower cabinet right shell 536 and the blower cabinet left shell 538.

In some embodiments, a cavity (or wall space) of the cabinet (or double-walled cabinet) may be at least partially filled with an insulating material. In various embodiments, a variety of insulating material may be used, including, but not limited to, fiber-glass insulation, non-fiberglass insulation, foam insulation (open and/or closed cell), insulation having volumetric expansion characteristics (e.g., expanding foam), and/or spray insulation. Some insulating material may comprise polyurethane. In the present embodiment, one or more of the heat exchanger cabinet wall space 542 and/or blower cabinet wall space 544 may be at least partially filled with an insulating material. At least partially filling one or more of the spaces 542, 544 may increase a structural integrity of the AHU 500, may increase a thermal resistance of the AHU 500 between the interior of the AHU 500 and the exterior of the AHU 500, may decrease air leakage from the AHU 500, and may reduce and/or eliminate the introduction of volatile organic compounds (VOCs) into breathing air (i.e., the air traveling through the AHU 500 fluid ducts) attributable to the AHU 500. Such a reduction in VOC emission by the AHU 500 may be attributable to the lack of and/or reduced use of traditional fiberglass insulation within the AHU 500 made possible by the insulative properties provided by insulation materials such as the polyurethane foam within the spaces 542, 544.

In some embodiments, each of the blower cabinet outer skin 518 and the heat exchanger cabinet outer skin 522 may be constructed of various materials, such as metal and/or plastic. Each of the heat exchanger cabinet right shell 532, the heat exchanger cabinet left shell 534, blower cabinet right shell 536, and blower cabinet left shell 538 may be constructed of a sheet molding compound (SMC). The SMC may be chosen for its ability to meet the primary requirements of equipment and/or safety certification organizations and/or its relatively rigid cleanable surfaces that are resistant to mold growth and compatible with the use of antimicrobial cleaners. Further, the insulating material (e.g., polyurethane foam) used to fill the cavities and/or spaces (e.g., spaces 542, 544) may comprise materials to enhance the thermal insulating characteristics of the foam (e.g., refrigerant and/or pentane). Of course, in alternative embodiments, any other suitable material may be used to form the components of the AHU 500.

Further, each of the heat exchanger cabinet right shell 532 and the heat exchanger cabinet left shell 534 may comprise an interior side surface 546, an interior rear surface 548, an exterior side surface 550, and an exterior rear surface. In an embodiment, protective housing structure 200 (such as disclosed in FIGS. 2A-2R) may be located and/or placed between interior side surface 546 and exterior side surface 550. Similarly, each of the blower cabinet right shell 536 and the blower cabinet left shell 538 may comprise an interior side surface 554, an interior rear surface 556, an exterior side surface, and an exterior rear surface. In some embodiments, it will be appreciated that each of the pairs of interior side surfaces 546, interior rear surfaces 548, exterior side surfaces 550, exterior rear surfaces, interior side surfaces 554, interior rear surfaces 556, exterior side surfaces, and exterior rear surfaces are substantially mirror images of each other. In some embodiments, the above listed pairs of surfaces may be substantially mirror images of each other about a bisection plane 562 (see FIG. 5B) that may be parallel and/or about parallel to both the AHU left side 514 and the AHU right side 516, and may be substantially equidistant from both the AHU left side 514 and the AHU right side 516.

It is understood that at least one embodiment is disclosed herein, and variations, combinations, and/or modifications of the disclosed embodiment(s) and/or features therein made by a person having ordinary skill in the art, are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure.

Having described the various systems and methods herein, various embodiments of the systems and methods can include, but are not limited to:

In a first embodiment, a protective housing structure for a heating, ventilation, and air conditioning (HVAC) system, the protective housing structure comprising a first end and second end with a centerline extending there between, and a cover section located between the first end and second end, the cover section having a dome-shaped top panel that is rigidly attached to a first sidewall and a second sidewall.

A second embodiment may include the protective housing structure of the first embodiment, further comprising: a first sealing section located adjacent to the cover section and between the first end and second end, the first sealing section having a first transverse member extending transverse to the centerline and rigidly coupled to the first side wall and the second side wall.

A third embodiment may include the protective housing structure of the first embodiment, the cover section further comprising: a third side wall having a top portion, a bottom portion, an inner surface, and an outer surface, the third side wall rigidly coupled with each of the edge portion of the dome-shaped top panel, the first side wall, and the second side wall, wherein the third side wall is transverse to the centerline and adjacent to the distal end of each side wall, and wherein the third side wall is so disposed that the outer surfaces of each of the first side wall, the second side wall, and the outer surface of the dome-shaped top panel are sealed from their respective inner surface.

A fourth embodiment may include the protective housing structure of the second embodiment, wherein the first side wall and second side wall each have a proximal end, a distal end, a top portion, a bottom portion, an inner surface, and an outer surface, wherein the inner surface of each first side wall and second side wall faces and extends along the centerline, and wherein the rigid coupling of the first sealing section to the first side wall and second side wall is proximate to the proximal end of each first side wall and second side wall.

A fifth embodiment may include the protective housing structure of the fourth embodiment, wherein the bottom portion of each first and second side wall have a lip portion that extends approximately orthogonal from the outer surface and along the length of each first side wall and second side wall to define a gap with the outer surface of each side wall.

A sixth embodiment may include the protective housing structure of the fourth embodiment, wherein the dome-shaped top panel having an inner surface, an outer surface, and an apex, wherein the outer surface of the dome-shaped top panel has a planar surface located at or near the apex of the dome-shaped top panel, and the outer surface of the dome-shaped top panel curves away from the apex towards an edge portion of the dome-shaped top panel, and wherein at least some of the edge portion of the dome-shaped top panel is rigidly coupled to the top portion of each of the first and second side walls, the first and second side walls being so configured as to vertically support the dome-shaped top panel at a predefined distance from the bottom portion of each of the first and second side walls and in such a way that each side wall is set apart a predetermined distance from each other.

A seventh embodiment may include the protective housing structure of the fourth embodiment, wherein the first and second side walls have a plurality of alternating ribs protruding in a direction substantially orthogonal to the inner surface of each side wall and towards the centerline of the protective housing structure, wherein each of the plurality of alternating ribs extends along the length of the inner surface of each side wall; each of the plurality of alternating ribs on the inner surface of the second side wall being so disposed as to substantially mirror the disposition of the plurality of alternating ribs on the inner surface of the first side wall.

An eighth embodiment may include the protective housing structure of the sixth embodiment, wherein the first transverse member having an upper surface that is a planar surface approximately parallel to the planar surface of the dome-shaped top panel's outer surface, is located approximately at the same elevation as the planar surface of the dome-shaped top panel's outer surface, wherein the first transverse member is disposed as to define an opening between the first side wall, second side wall, first transverse member, and dome-shaped top panel, wherein the opening extends along the centerline for a predetermined distance from the first end toward the second end, and wherein the first transverse member is configured as to form a vertically extended lip having lateral flexibility in a direction along the centerline of the protective housing structure, and wherein the first transverse member is so disposed that the outer surfaces of each of the first side wall, second side wall, first transverse member, and dome-shaped top panel are sealed from their respective inner surface.

A ninth embodiment may include the protective housing structure of the first embodiment, further comprising: a second sealing section.

A tenth embodiment may include the protective housing structure of the first embodiment, wherein the protective housing structure is manufactured by a process of casting, molding, forming, or photopolymerization.

An eleventh embodiment may include the protective housing structure of the tenth embodiment, wherein the protective housing structure is a monocoque structure being adapted to resist material deformation.

A twelfth embodiment may include the protective housing structure of the seventh embodiment, further comprising: a control panel plate that operatively engages with at least two ribs of each first side wall and second side wall, wherein the control panel plate is disposed between the at least two ribs of each first side wall and second side wall, and wherein the at least two ribs of each first side wall and second side wall are configured to secure the control panel plate in a direction along the centerline at least by frictional force.

A thirteenth embodiment may include the protective housing structure of the twelfth embodiment, further comprising: a third side wall having a proximal end, a distal end, a top portion, a bottom portion, an inner surface, and an outer surface, the third side wall rigidly coupled with each of the edge portion of the dome-shaped top panel, the first side wall, and the second side wall, wherein the third side wall is transverse to the centerline and adjacent to the distal end of each side wall, wherein the third side wall is so disposed that the outer surfaces of each of the first and second side walls and the outer surface of the dome-shaped top panel are sealed from their respective inner surface, and wherein the third side wall is configured in such a way that the control panel plate is not prohibited from operatively engaging with two ribs of each sidewall.

A fourteenth embodiment may include the protective housing structure of the sixth embodiment, wherein the dome-shaped top panel is so configured as to resist material deformation orthogonal to the planar surface located at or near the apex, and wherein the inner surface of the dome-shaped top panel has a concave curve facing the centerline.

A fifteenth embodiment may include the protective housing structure of the fourteenth embodiment, wherein the dome-shaped top panel includes a hemi-ellipsoidal curvature.

A sixteenth embodiment may include the protective housing structure of the sixth embodiment, further comprising: a second sealing section located adjacent to, and rigidly coupled with, the first sealing section and between the first and second ends, the second sealing section having a second transverse member extending transverse to the centerline and rigidly coupled to the proximal end of each of the first and second side walls, the second transverse member having an upper surface that is a planar surface approximately parallel to the planar surface of the dome-shaped top panel's outer surface, is located approximately at the same elevation as the planar surface of the dome-shaped top panel's outer surface, wherein the second transverse member is disposed as to define a channel with a proximal side of a first sealing section.

A seventeenth embodiment may include the protective housing structure of the sixteenth embodiment, wherein the second transverse member of the second sealing section is configured as to form a vertically extended lip having lateral flexibility that allows material deflection along the centerline of the protective housing structure, and wherein the second transverse member of the second sealing section is so disposed that the outer surfaces of each of the side walls and the outer surface of the dome-shaped top panel are sealed from their respective inner surface.

An eighteenth embodiment may include the protective housing structure of any of the second to eighth embodiments, further comprising: a second sealing section located adjacent to, and rigidly coupled with, the first sealing section and between the first and second ends, the second sealing section having a second transverse member extending transverse to the centerline and rigidly coupled to the proximal end of each of the first and second side walls, the second transverse member having an upper surface that is a planar surface approximately parallel to the planar surface of the dome-shaped top panel's outer surface, is located approximately at the same elevation as the planar surface of the dome-shaped top panel's outer surface, wherein the second transverse member of the second sealing section is disposed as to define a u-shaped channel with a proximal side of the first sealing section.

A nineteenth embodiment may include the protective housing structure of the eighteenth embodiment, wherein the u-shaped channel defined by the second transverse member of the second sealing section is closed on one end.

A twentieth embodiment may include the protective housing structure of the thirteenth embodiment, wherein the third side wall is configured as to define at least one opening between the proximal end and the distal end of the third side wall.

A twenty first embodiment may include the protective housing structure of the sixteenth embodiment, wherein the channel is u-shaped.

A twenty second embodiment may include the protective housing structure of the twentieth embodiment, wherein the at least one opening defined by the third side wall is configured to receive plug that covers the at least one opening and forms a seal between the proximal end and distal end of the third side wall, wherein the seal is about airtight.

A twenty third embodiment may include the protective housing structure of the eleventh embodiment, wherein the protective housing structure is a unitary structure.

A twenty fourth embodiment may include the protective housing structure of the twenty third embodiment, wherein all of the rigid couplings are configured to form a unitary structure, wherein the unitary structure does not comprise any joints.

In a twenty fifth embodiment, a heating, ventilation, and air conditioning system (HVAC system) comprises a double-walled cabinet having an at least one exterior wall and an interior wall, wherein the at least one exterior wall and the interior wall are configured to form a wall cavity that is at least partially bound by each of the exterior wall and the interior wall; and a shroud comprising a plurality of walls that are rigidly attached to a dome-shaped cover having a planar surface at or near an apex of the dome-shaped cover, wherein the shroud is at least partially within the wall cavity and is attached to an exterior wall or an interior wall of the double-walled cabinet.

A twenty sixth embodiment may include the system of the twenty fifth embodiment, further comprising a control panel at least partially disposed within the shroud.

A twenty seventh embodiment may include the system of the twenty fifth embodiment, further comprising an insulation material that is disposed within the wall cavity.

A twenty eighth embodiment may include the system of the twenty seventh embodiment, wherein the insulation material is disposed within the wall cavity, and wherein the insulation material at least partially encapsulates an outer surface of the shroud.

A twenty ninth embodiment may include the system of the twenty seventh embodiment, wherein at least a portion of the shroud is integrally formed with any of the exterior wall or the interior wall inside the wall cavity of the double-walled cabinet.

A thirtieth embodiment may include the system of the twenty fifth embodiment, wherein the shroud is a unitary structure that does not comprise any joints.

A thirty first embodiment may include the system of the twenty seventh embodiment, wherein the insulation material comprises an expanding foam insulation, wherein the expanding foam insulation that is at least one of an open cell foam insulation or closed cell foam insulation, and wherein the shroud is polar in nature such that the shroud resists adhesion from the expanding foam insulation.

A thirty second embodiment may include the system of the thirty first embodiment, wherein the expanding foam insulation is configured to volumetrically expand within the wall cavity, and wherein the expanding foam insulation comprises polyurethane.

In a thirty third embodiment, a heating, ventilation, and air conditioning system (HVAC system) comprises: a cabinet having at least one wall comprising an interior shell and an exterior skin associated with the interior shell that is configured to form a wall space that is at least partially bound by each of the interior shell and the exterior skin; the at least one wall being so configured as to at least partially define a fluid duct of the cabinet; a sealable enclosure, wherein at least a portion of the sealable enclosure is attached with the inner shell of the cabinet; a control component at least partially disposed within the wall space and the sealable enclosure; and an insulation material disposed within the wall space and configured to prevent airflow through at least part of the wall space.

A thirty fourth embodiment may include the system of the thirty third embodiment, wherein the sealable enclosure is a unitary structure, wherein the unitary structure does not comprise any joints.

A thirty fifth embodiment may include the system of the thirty third embodiment, wherein the insulation material at least partially encapsulates an outer surface of the sealable enclosure within the wall space.

A thirty sixth embodiment may include the system of the thirty third embodiment, wherein the insulation material comprises an expanding foam insulation that is at least one of an open cell foam insulation or closed cell foam insulation.

A thirty seventh embodiment may include the system of the thirty third embodiment, wherein the expanding foam insulation comprises polyurethane.

A thirty eighth embodiment may include the system of the thirty fifth embodiment, wherein the sealable enclosure is configured to distribute an applied force via a unitary skin structure.

A thirty ninth embodiment may include the system of the thirty fourth embodiment, wherein unitary structure of the sealable enclosure is a monocoque skin structure, and wherein the unitary structure is configured to distribute an applied force via the monocoque skin structure.

A fortieth embodiment may include the system of the thirty ninth embodiment, wherein the monocoque skin structure is configured to resist material deformation from the applied force, and wherein the applied force is at least 10 pounds per square inch.

In a forty first embodiment, a method for protecting components of a heating, ventilation, and air conditioning system is disclosed, the method comprising: rigidly attaching a shroud to an interior wall of a double-walled cabinet, the double-walled cabinet having an at least one exterior wall and an interior wall, the at least one exterior wall and the interior wall being disposed in such a way as to form a wall cavity that is at least partially bound by each of the exterior wall and the interior wall, the shroud being a unitary skin structure comprising a plurality of walls and a dome-shaped top cover, wherein the dome-shaped top cover includes a planar surface at or near an apex of the dome-shaped top cover, wherein the shroud is located within the wall cavity of the double-walled cabinet, and the shroud is configured to define an opening between the plurality of walls and beneath the dome-shaped top cover, the opening being configured to receive a control component; and resisting a compressive force using the shroud.

A forty second embodiment may include the method of the forty first embodiment, wherein the unitary skin structure of the shroud is a monocoque structure.

A forty third embodiment may include the method of the forty first embodiment, further comprising: distributing an applied force via the unitary skin structure.

A forty fourth embodiment may include the method of the forty third embodiment, further comprising: resisting material deformation from the applied force using the unitary skin structure.

A forty fifth embodiment may include the method of the forty first embodiment, wherein the planar surface of the dome-shaped top cover is about parallel with the at least one exterior wall of the double-walled cabinet.

A forty sixth embodiment may include the method of the forty first embodiment, further comprising: inserting insulation material into the wall cavity between the at least one exterior wall and the interior wall, wherein the insulation material at least partially fills the wall cavity of the double-walled cabinet.

A forty seventh embodiment may include the method of the forty sixth embodiment, wherein the insulation material comprises an expanding polyurethane foam.

A forty eighth embodiment may include the method of the forty seventh embodiment, further comprising: responsive to inserting the insulation material, at least partially contacting the shroud with expanding polyurethane foam.

A forty ninth embodiment may include the method of the forty seventh embodiment, further comprising: responsive to the expanding polyurethane foam at least partially coming into contact with the shroud, forming a seal between a peripheral edge of the shroud and at least the inner wall of the double-walled cabinet.

A fiftieth embodiment may include the method of the forty sixth embodiment, further comprising the step: responsive to inserting insulation material into the wall cavity between the at least one exterior wall and the interior wall, forming a seal between a peripheral edge of the shroud and at least the inner wall of the double-walled cabinet.

A fifty first embodiment may include the method of any of the forty ninth to fiftieth embodiments, further comprising: preventing insulation material from penetrating into an opening of the shroud using the seal, wherein the shroud is configured to receive a control component.

A fifty second embodiment may include the method of any of the forty ninth to fiftieth embodiments, wherein the seal is an air tight seal.

A fifty third embodiment may include the method of any of the forty ninth to fiftieth embodiments, wherein the seal is a water tight seal.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A protective housing structure for a heating, ventilation, and/or air conditioning (HVAC) system, the protective housing structure comprising:

a first end and second end with a centerline extending therebetween;

a cover section located between the first end and second end, the cover section having a dome-shaped top panel that is rigidly attached to a first sidewall and a second sidewall, wherein an apex of the dome-shaped top panel is located at a first distance from the centerline;

a third sidewall rigidly coupled with each of an edge portion of the dome-shaped top panel, the first sidewall, and the second sidewall, and wherein the third sidewall is transverse to the centerline and adjacent to a distal end of each of the first sidewall and the second sidewall, wherein at least one opening is defined between a proximal end and a distal end of the third sidewall;

at least one plug receivable by the at least one opening, the at least one plug configured to allow axial passage of a wire therethrough; and a first sealing section located adjacent to the cover section and between the first end and second end, the first sealing section having a first transverse member extending transverse to the centerline and rigidly coupled to the first sidewall and the second sidewall to partially define a u-shaped channel and a cavity to receive a control panel of the HVAC system, wherein an outer surface of the first transverse member is located at a second distance from the centerline that is equal to the first distance.

2. The protective housing structure of claim 1, further comprising:

a second sealing section located adjacent to, and rigidly coupled with, the first sealing section and between the first and second ends, the second sealing section having a second transverse member extending transverse to the centerline and rigidly coupled to a proximal end of each of the first and second sidewalls, wherein the second transverse member is disposed as to partially define the u-shaped channel with a proximal side of the first sealing section.

3. The protective housing structure of claim 1, wherein the third sidewall is so disposed that outer surfaces of the first sidewall, the second sidewall, the third sidewall, and the dome-shaped top panel are sealable.

4. The protective housing structure of claim 1, wherein the dome-shaped top panel is so configured as to resist material deformation orthogonal to a planar surface located at or near the apex of the dome-shaped top panel.

5. The protective housing structure of claim 1, wherein the protective housing structure is a monocoque structure operable to resist material deformation.

6. The protective housing structure of claim 1, wherein the protective housing structure is formed by at least one of:

a casting material;

a molding material;

a forming material; or a photopolymerization material.

7. The protective housing structure of claim 1, further comprising a plurality of ribs extending into the cavity from an inner surface of the first sidewall and from an inner surface of the second sidewall, wherein the plurality of ribs are configured to frictionally secure the control panel along the centerline of the protective housing structure.

8. A protective housing structure for a heating, ventilation, and/or air conditioning (HVAC) system, the protective housing structure comprising:

a first end and second end with a centerline extending therebetween;

a cover section located between the first end and second end, the cover section having a dome-shaped top panel that is rigidly attached to a first sidewall and a second sidewall, wherein an apex of the dome-shaped top panel is located at a first distance from the centerline;

a third sidewall rigidly coupled with a respective edge portion of each of the dome-shaped top panel, the first sidewall, and the second sidewall and is transverse to the centerline and adjacent to a distal end of each of the first sidewall and the second sidewall to define an interior space, wherein a plurality of openings are defined between a proximal end and a distal end of the third sidewall;

a plurality of plugs receivable by respective ones of the plurality of openings, at least some of the plurality of plugs configured to allow axial passage of at least one wire each therethrough; and a first sealing section located adjacent to the cover section and between the first end and second end, the first sealing section having a first transverse member extending transverse to the centerline and rigidly coupled to the first sidewall and the second sidewall to partially define a u-shaped channel and a cavity to receive a control panel of the HVAC system, wherein an outer surface of the first transverse member is located at a second distance from the centerline that is equal to the first distance.

9. The protective housing structure of claim 8, further comprising:

a second sealing section located adjacent to, and rigidly coupled with, the first sealing section and between the first and second ends, the second sealing section having a second transverse member extending transverse to the centerline and rigidly coupled to a proximal end of each of the first and second sidewalls, wherein the second transverse member is disposed as to partially define the u-shaped channel with a proximal side of the first sealing section.

10. The protective housing structure of claim 8, wherein the third sidewall is so disposed that outer surfaces of the first sidewall, the second sidewall, the third sidewall, and the dome-shaped top panel are sealable.

11. The protective housing structure of claim 8, wherein the dome-shaped top panel is so configured as to resist material deformation orthogonal to a planar surface located at or near the apex of the dome-shaped top panel.

12. The protective housing structure of claim 8, wherein the protective housing structure is a monocoque structure operable to resist material deformation.

13. The protective housing structure of claim 8, wherein the protective housing structure is formed by at least one of:

a casting material;

a molding material;

a forming material; or a photopolymerization material.

14. The protective housing structure of claim 8, further comprising a plurality of ribs extending into the cavity from an inner surface of the first sidewall and from an inner surface of the second sidewall, wherein the plurality of ribs are configured to frictionally secure the control panel along the centerline of the protective housing structure.

* * * * *